US012364371B2

(12) United States Patent
Petrarca et al.

(10) Patent No.: US 12,364,371 B2
(45) Date of Patent: Jul. 22, 2025

(54) SOAP FOAM GENERATING MACHINE

(71) Applicant: Little Kids, Inc., Seekonk, MA (US)

(72) Inventors: Michael Petrarca, Chepachet, RI (US); Michael Fusco, Greenville, RI (US)

(73) Assignee: Little Kids, Inc., Seekonk, MA (US)

( * ) Notice: Subject to any disclaimer, the term of this patent is extended or adjusted under 35 U.S.C. 154(b) by 262 days.

(21) Appl. No.: 18/162,319

(22) Filed: Jan. 31, 2023

(65) Prior Publication Data

US 2023/0240483 A1 Aug. 3, 2023

Related U.S. Application Data

(60) Provisional application No. 63/305,442, filed on Feb. 1, 2022.

(51) Int. Cl.
*A47K 5/16* (2006.01)
*A47K 5/12* (2006.01)

(52) U.S. Cl.
CPC ..... *A47K 5/16* (2013.01); *A47K 5/1211* (2013.01)

(58) Field of Classification Search
CPC ..... A47K 5/16
USPC ..... 222/190
See application file for complete search history.

(56) References Cited

U.S. PATENT DOCUMENTS 2,090,727 A 8/1937 Gosman
3,913,260 A * 10/1975 Corbett ..... B62J 50/40 446/16
3,946,947 A 3/1976 Schneider
4,603,812 A 8/1986 Stoesser
4,901,925 A * 2/1990 Blake, III ..... B05B 7/0037 239/371
5,230,648 A 7/1993 Kelly
5,238,155 A * 8/1993 Blake, III ..... B05B 7/0025 222/400.7
6,053,369 A * 4/2000 Hoang ..... B05B 7/2427 375/E7.04
6,138,875 A 10/2000 Condon
6,264,450 B1 * 7/2001 Woodruff ..... F04C 5/00 416/240
7,086,612 B2 8/2006 Crawford
7,281,642 B2 10/2007 Orlowski
8,075,363 B2 12/2011 Gomzar
8,231,111 B2 7/2012 Chang
8,783,517 B2 7/2014 Malik
(Continued)

FOREIGN PATENT DOCUMENTS

EP 2450090 A1 * 5/2012 ..... A63H 33/28
WO WO-2012104724 A2 * 8/2012 ..... A63H 33/28

*Primary Examiner* — Paul R Durand
*Assistant Examiner* — Michael J. Melaragno
(74) *Attorney, Agent, or Firm* — Hinckley, Allen & Snyder, LLP; David Josephs

(57) ABSTRACT

The invention provides an improved machine for generating soap foam that includes a single drive, such an electric motor or human-driven crank that simultaneously drives both a pump, such a peristaltic pump, and a blower. Soap solution is delivered in front of the blower in a waterfall-like manner by gravity so it can be urged through a fine mesh fabric screen to introduce air for the formation of soap foam. The motor speed, drive gearing for the pump, the fan turbine for the blower and soap solution nozzle configuration are selected to provide soap foam of the desired volume, density, and flow.

17 Claims, 20 Drawing Sheets

(56) References Cited

U.S. PATENT DOCUMENTS

| | | | | |
|---|---|---|---|---|
| 9,861,942 | B1 | 1/2018 | Paul | |
| 10,029,266 | B2 | 7/2018 | Gantenbaum | |
| 2004/0001550 | A1 | 8/2004 | Dunham | |
| 2005/0258192 | A1* | 11/2005 | Matthews | C11D 3/382 222/190 |
| 2007/0241137 | A1* | 10/2007 | Willis | B05B 7/0037 222/190 |
| 2009/0163109 | A1* | 6/2009 | Thai | A63H 33/28 446/16 |
| 2009/0200340 | A1* | 8/2009 | Ophardt | F04C 11/001 222/190 |
| 2009/0209163 | A1* | 8/2009 | Thai | A63H 33/28 446/15 |
| 2010/0051642 | A1* | 3/2010 | Wong | B01F 25/4523 222/145.6 |
| 2010/0089951 | A1* | 4/2010 | Yates | B05B 7/0466 222/145.6 |
| 2012/0270462 | A1* | 10/2012 | Lo | A63H 33/28 446/15 |
| 2012/0285992 | A1* | 11/2012 | Ciavarella | B05B 9/0416 222/138 |
| 2013/0200109 | A1* | 8/2013 | Yang | A47K 5/16 222/190 |
| 2023/0055009 | A1* | 2/2023 | Lo | A63H 33/28 |
| 2023/0240483 | A1* | 8/2023 | Petrarca | A47K 5/16 222/190 |
| 2023/0241527 | A1* | 8/2023 | Petrarca | A63H 33/28 446/16 |
| 2023/0296348 | A1* | 9/2023 | Petrarca | F41B 9/0071 222/79 |
| 2023/0347362 | A1* | 11/2023 | Koya | B05B 12/008 |

* cited by examiner

SOAP FOAM GENERATING MACHINE

CROSS REFERENCE TO RELATED APPLICATION

This application is related to, and claims benefit from, U.S. Provisional Application No. 63/305,442, filed on Feb. 1, 2022, entitled "SOAP FOAM GENERATING MACHINE," incorporated by reference in its entirety, herein.

BACKGROUND OF THE INVENTION

The invention is in the field of motor driven, soap bubble and soap foam producing toys. The present invention is particularly related to toys that generate soap foam in a continuous and voluminous flow.

Mechanically driven, such an electric motor-driven or non-motor driven (e.g., human-driven), soap bubble and foam producing toys have been around for many years. Typically, such toys have a soap solution reservoir, a motive power source, for example, a battery, a motor, a pump, a soap foam/bubble solution feed tube, and a soap bubble forming structure, such as a wand or wand-like circular aperture for forming the soap bubbles. It should be understood that toys that generate soap foam and soap bubbles are highly related in that they both create structures made of soap for play but they are different. First, soap "bubbles" are discrete structures filled with gas (e.g. air) trapped in film shell of soap. On the other hand, "foam" is also formed by trapping pockets of gas in a liquid or solid, such as air trapped in a shell or walls of soap. In most foams, the volume of gas is large, with thin films of liquid or solid separating the regions of gas rather than discrete and separate structures filled with gas. Soap foams are also commonly known as suds.

The machine of the present invention has particular use in generating soap foam but could also be modified to create soap bubbles. The discussion herein and below will focus on the creation of soap foam with the machine of the present invention.

There is a need in the industry for a machine to produce large volumes of quality soap foam to maximize fun and enjoyment by the user.

In the prior art, these soap foam producing toys commonly include a soap solution delivery or dispensing structure and a blower that blows air into the soap solution to drive the soap solution into and through a mesh material, such as a fabric or screen material, or the like, to introduce air into the soap solution to, thereby, transform the liquid soap solution into an air-filled sudsy foam material, which is outputted from the machine for use and play.

However, the delivery of the soap solution and the blowing of air in prior art machines cannot deliver the desired large volumes of soap foam in a portable and at a low cost price point required by the industry.

Therefore, there is a need for a machine that can produce large volumes of soap foam that is battery operated, safe for children, portable and at a low affordable cost.

There is a need for a soap foam machine that can efficiently blow air and pump the soap solution using a single motor.

There is a need for a soap foam machine that mechanically links a soap pump and air blower for the creation of the foam.

There is a need for a soap foam machine that can direct excess soap solution back into a reservoir for further use.

SUMMARY OF THE INVENTION

The invention provides an improved machine for generating soap foam that includes a single motor that simultaneously drives both a pump, such a peristaltic pump, and a blower. Soap solution is delivered in front of the blower in a waterfall-like manner by gravity so it can be urged through a fine mesh material, such as fabric or screen to introduce air for the formation of soap foam. The motor speed, drive gearing for the pump, the fan turbine for the blower and soap solution nozzle configuration are selected to provide soap foam of the desired volume, density, and flow.

Therefore, an object of the invention is to provide a machine that can produce large volumes of soap foam.

A further object of the invention is to provide a soap foam machine that can efficiently blow air and pump the soap solution using a single electrically driven motor.

Another object of the present invention is to provide a human-driven soap foam machine that can blow air and pump soap solution.

Yet another object of the invention is to provide a soap foam machine that mechanically links a soap pump and air blower for the creation of the foam.

Yet another object of the present invention is to provide a soap foam machine that can direct excess soap solution back into a reservoir for further use.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

DETAILED DESCRIPTION OF THE PREFERRED EMBODIMENT

The new and unique soap foam machine 10 that generates large volumes of soap foam is described in detail below.

Figure 1:
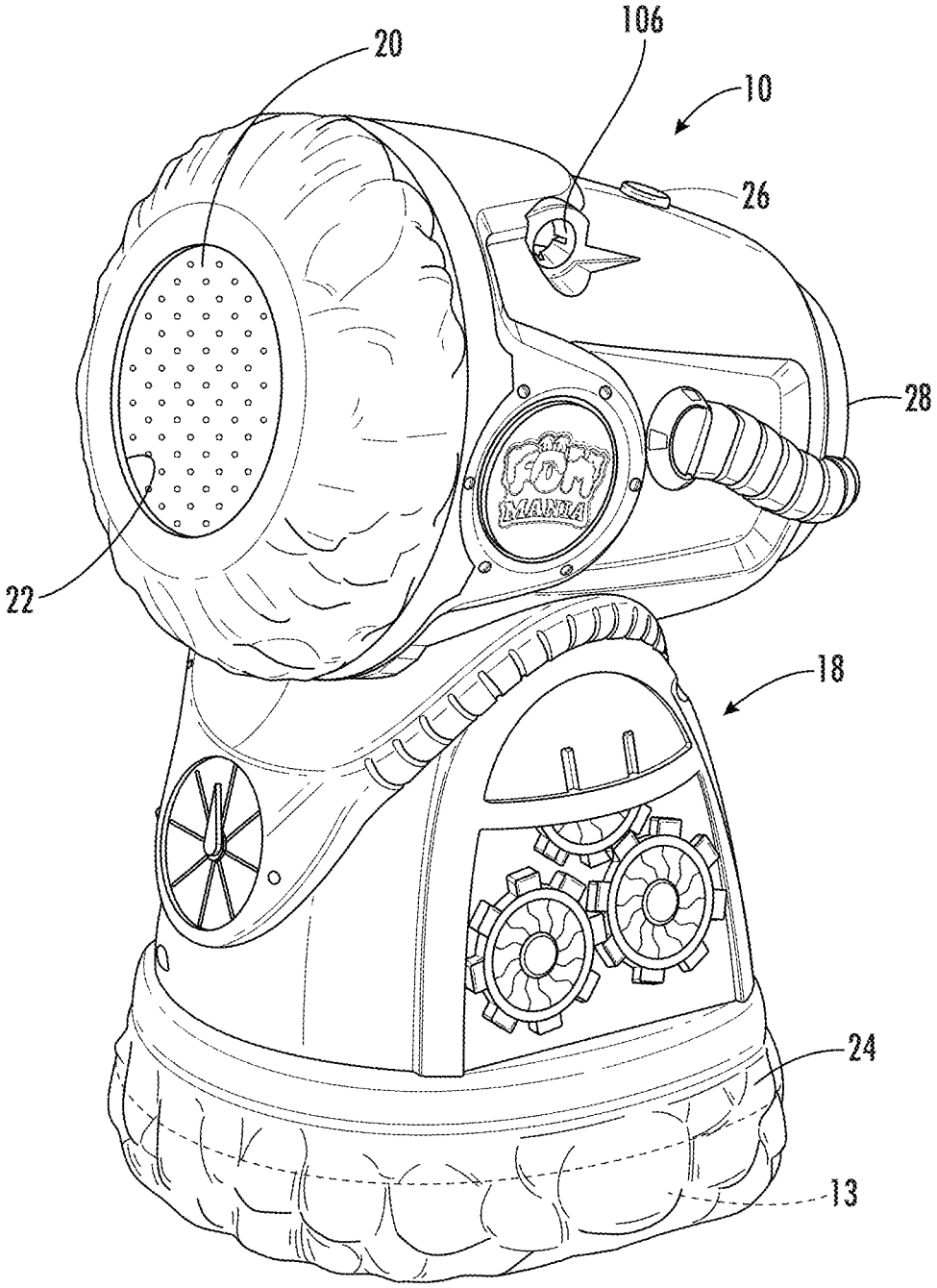
FIG. 1 shows a front perspective view of the soap foam machine of the present invention.
Figure 2:
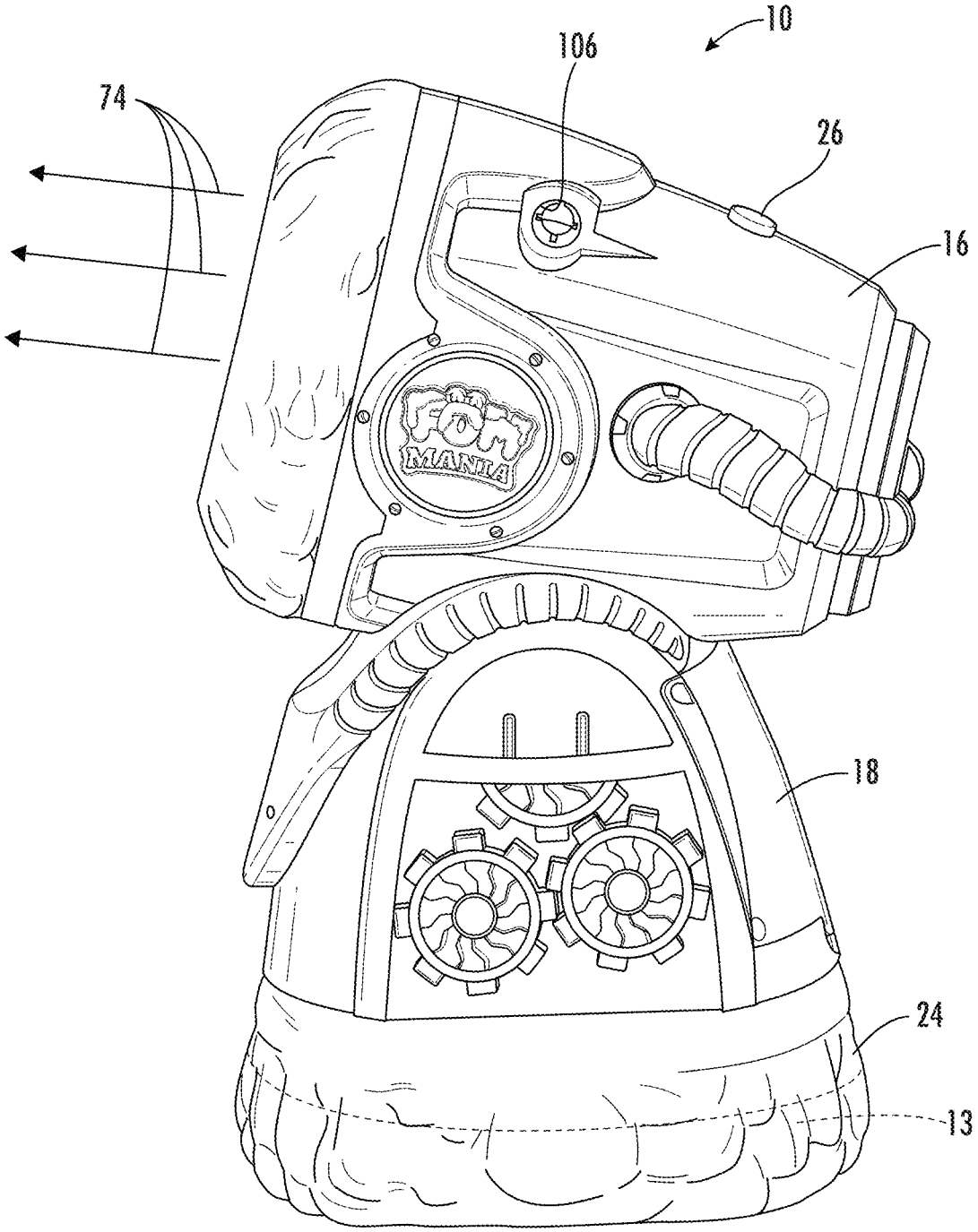
FIG. 2 shows a side view of the present invention shown in FIG. 1 with handle not shown for ease of illustration.
Figure 3:
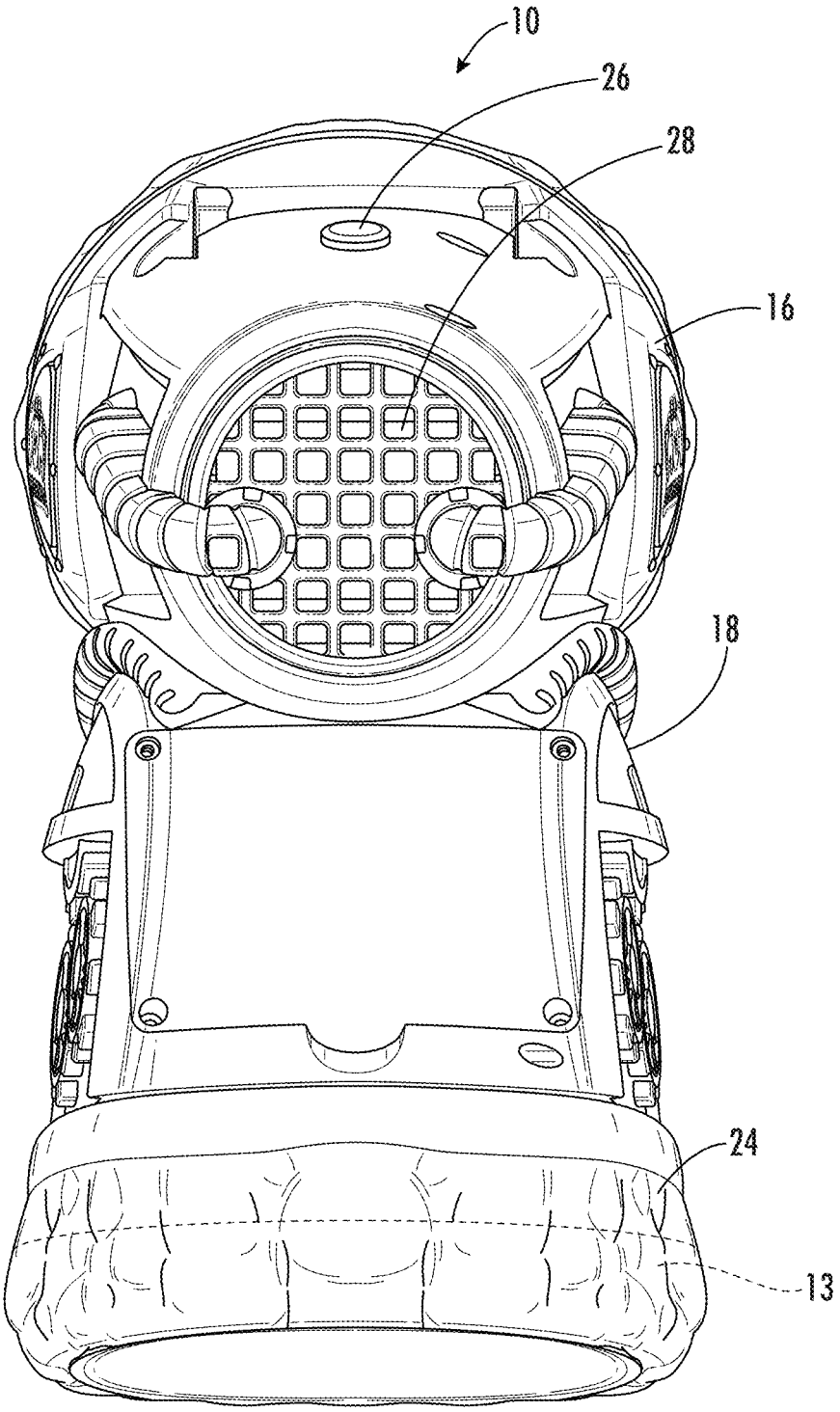
FIG. 3 shows a rear view of the present invention shown in FIG. 1 with handle not shown for ease of illustration.

FIG. 1 shows a front perspective view of the soap foam machine of the present invention while FIG. 2 shows a FIG. 2 shows a side view of the present invention 10 shown in FIG. 1. FIG. 3 shows a rear view of the present invention 10 shown in FIG. 1 while FIG. 4 shows the machine 10 of the present invention in use producing foam 12 with a handle 14 shown again attached in place to facilitate lifting and transport of the machine 10.

Referring to FIGS. 1-4, the machine 10 of the present invention includes an outer upper housing 16 and outer lower housing 18 that contain the components of the present invention. A mesh material 20, such as a fabric, covers output port 22 is provided, as can be seen in FIG. 1, for example. A releasable soap foam solution reservoir 24 is releasably attached to the bottom of the lower housing 18, as will be discussed in detail below in connection with FIGS. 11, 16-18. A power button 26 is provided, which is electrically connected to the electronics of the machine 10 to turn it on and off, as will be described below.

The output of the machine 10 is preferably angled upward slightly to improve projection and flow of the soap foam 12 generated through the mesh material 20, such as fabric, across output port 22. FIG. 3 shows as rear view of the present invention 10 where a back vent grille 28 is provided to help improve and provide air flow through the machine 10 for the generation of the soap foam 12, namely to assist in the supply of air into the air blower 30 to avoid the creation of pressure and vacuum within the housing 16, 18 of the present invention.

Figure 4:
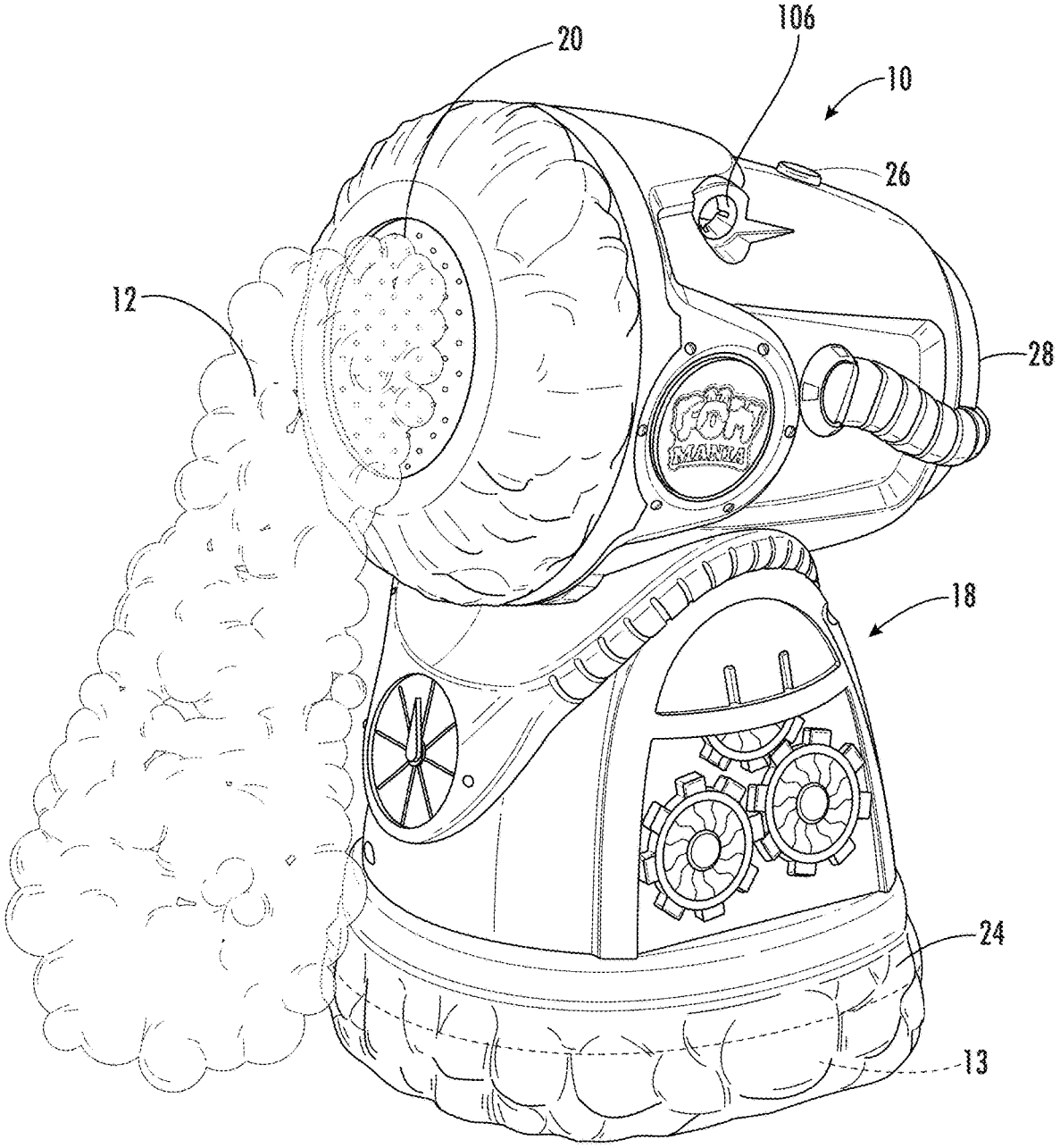
FIG. 4 shows the machine of the present invention in use and handle shown attached in place.
Figure 8:
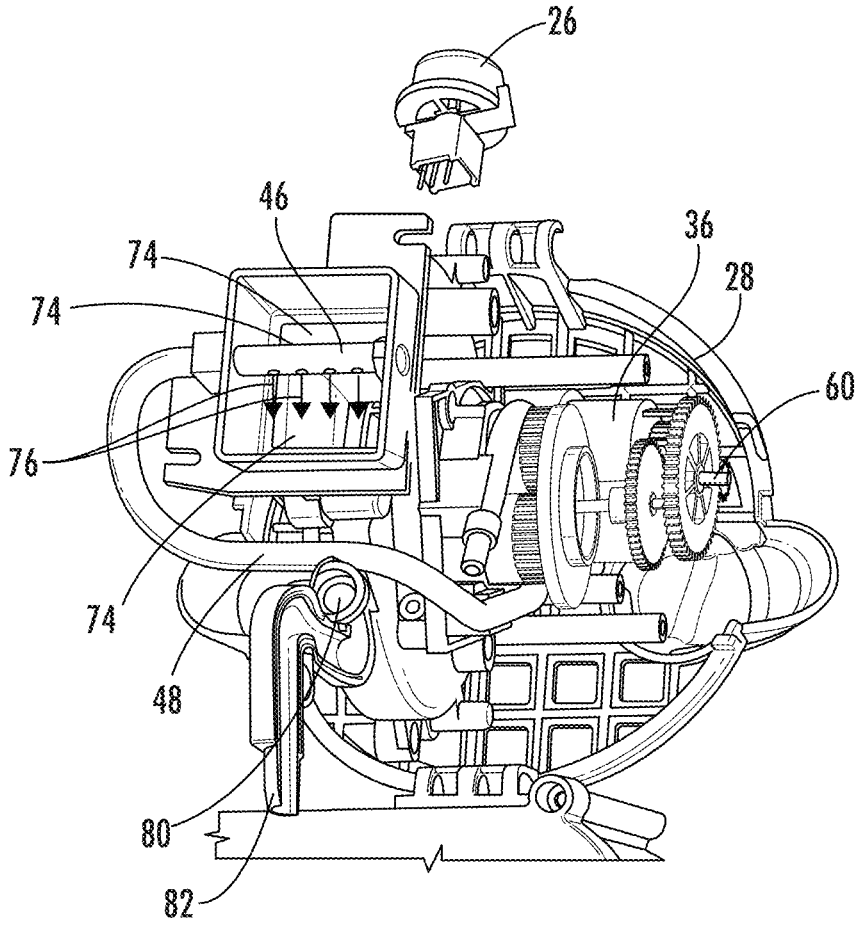
FIG. 8 is a front view of the machine of the present invention with housing removed to show the pump and gearing linked to the motor.

FIG. 4 shows the machine 10 of the present invention in use, with the ON/OFF but ton turned on whereby the soap foam solution pump 32 and air blower 30, as in FIG. 8, are simultaneously activated whereby where the soap 12 is being driven across the front mesh material 20 to inject air therein to generate the desired foam consistency. Thus, large volumes of foam 12 is created on the opposing side of the mesh material 20, such as fabric, across output port 22 where, essentially, foam 12 is exiting through the entire area of the output port 22 in a preferably continuous column of foam 12.

FIGS. 5-15 show the internal components of the machine 10 of the present invention to illustrate how the soap foam solution 13 is pulled from the soap foam solution reservoir 24, exposed to a flow of air created by the air blower 30 to be blown through the mesh material 20 at the output port 22 to add air to the soap solution 13 to create the desired flow of a continuous column of soap foam 12.

Figure 5:
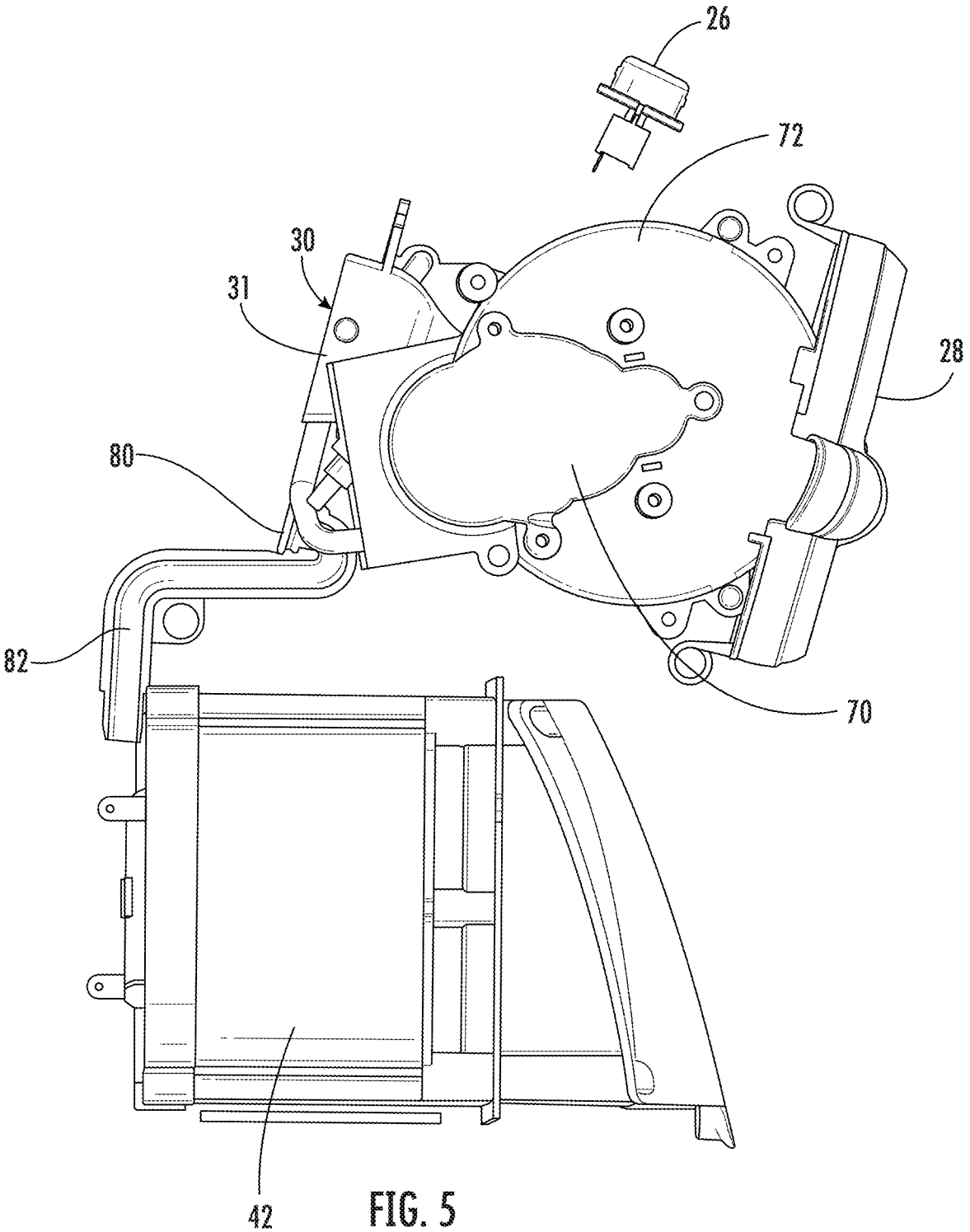
FIG. 5 is a right side, partially cut away view of the present invention with various component hidden for ease of discussion of the invention.

Referring now to FIG. 5, a right side, partially cut away view of the present invention 10 is shown with the outer housing 16, 18, soap foal solution reservoir 24, and other components removed so the internal components, including the electrically driven motor 36, gear housing 38, and the like, may be more easily seen for discussion herein. In general, an ON/OFF button 26 is provided that is electrically interconnected to the power supply 40, preferably batteries in a battery storage compartment 42, to actuate the machine 10 on and off. The ON/OFF 26 button is electrically interconnected to the battery power supply 40. Electrical wires are not shown for illustration purposes but it should be understood that the ON/OFF button 26 can be electrically interconnected to the power supply 40 in many different ways know in the art. The blower output 30 is preferably angled in similar fashion to the angled output port 22 of the machine as shown in FIG. 2, for example, so when generated foam 12 exits the output port 22 it is urged in a direction slightly upward to avoid dripping or flowing directly downward to compensate for the effect of gravity on the foam 12, which is somewhat dense and heavy and does not float in the air like a bubble type structure that could be created by soap solution 13. FIG. 5 also shows the rear vent plate 28 that has an array of apertures 29 therein to permit air to enter to supply the air blower 30 while preventing unwanted hands or fingers from entering inside the housing 16 to avoid injury.

Figure 6:
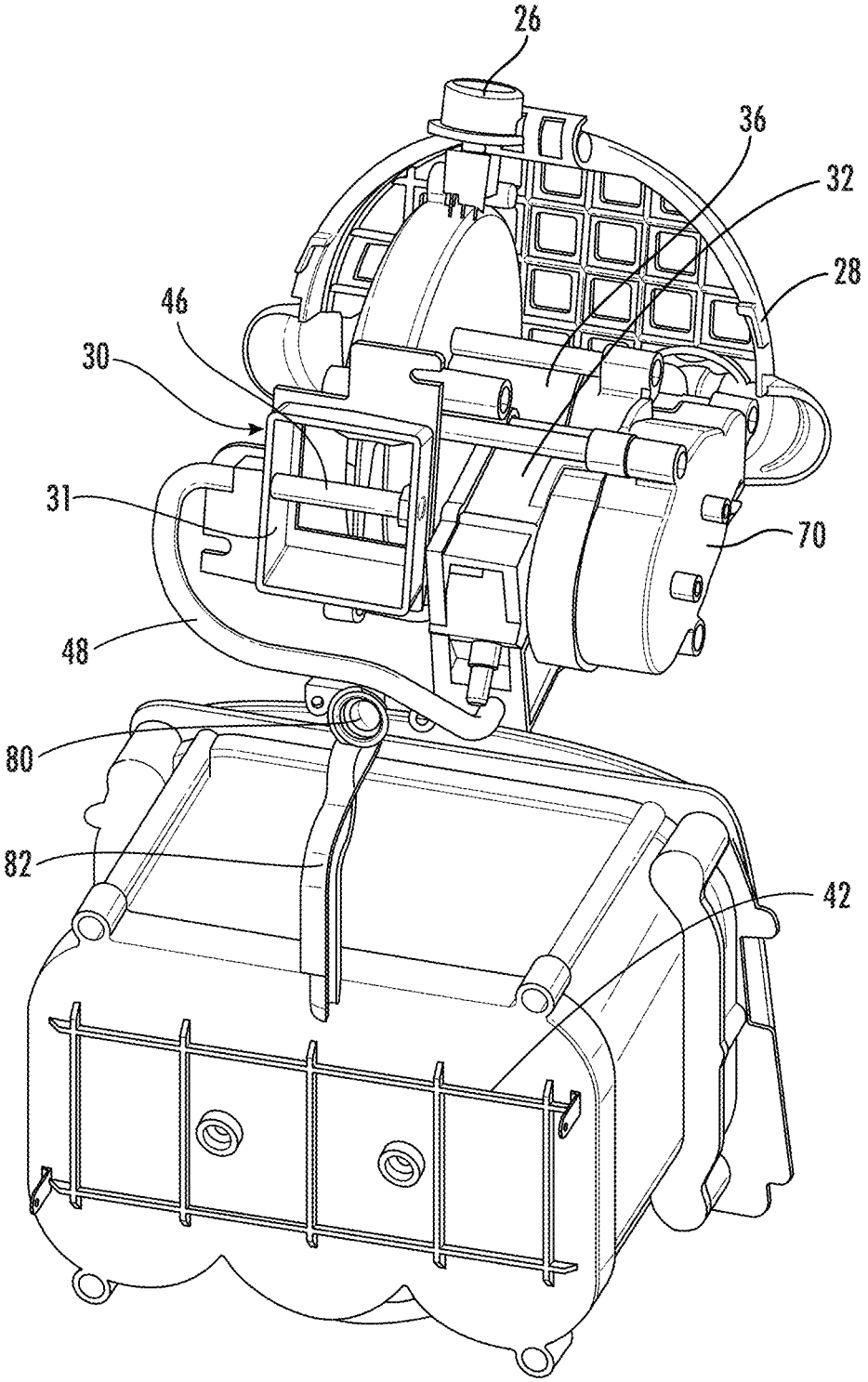
FIG. 6 is a top front partially cut away perspective view of the present invention showing the air blower.

In FIG. 6, the outer housing 16, 18 is again not shown for illustration purposes to show a front partially cut away perspective view of the present invention 10. The air blower 30, the air blower output nozzle 46 and gearing housing 38 can be seen whereby soap solution 13 is pumped through the soap foam solution line 48 and out through an array of apertures 50 facing downwardly at the free end portion of the soap solution supply line 48 that resides in the air blower output port 52 of the air blower, generally referred to as 30. Thus a curtain of soap foam solution 13 drips downwardly in front of the air blower 30 to then be urged forwardly through the mesh material 20, such as a fabric, for creation of soap foam 12. FIG. 6 also shows position of the battery storage 42, which is the supply of electricity to power the machine 10 of the present invention, as controlled by the ON/OFF button 26 located on the top of the device 10. It should be noted that the positioning of the batteries 54, as in FIG. 14, and ON/OFF button are shown as an example but they may be located anywhere in the machine 10 of the present invention.

Figure 7:
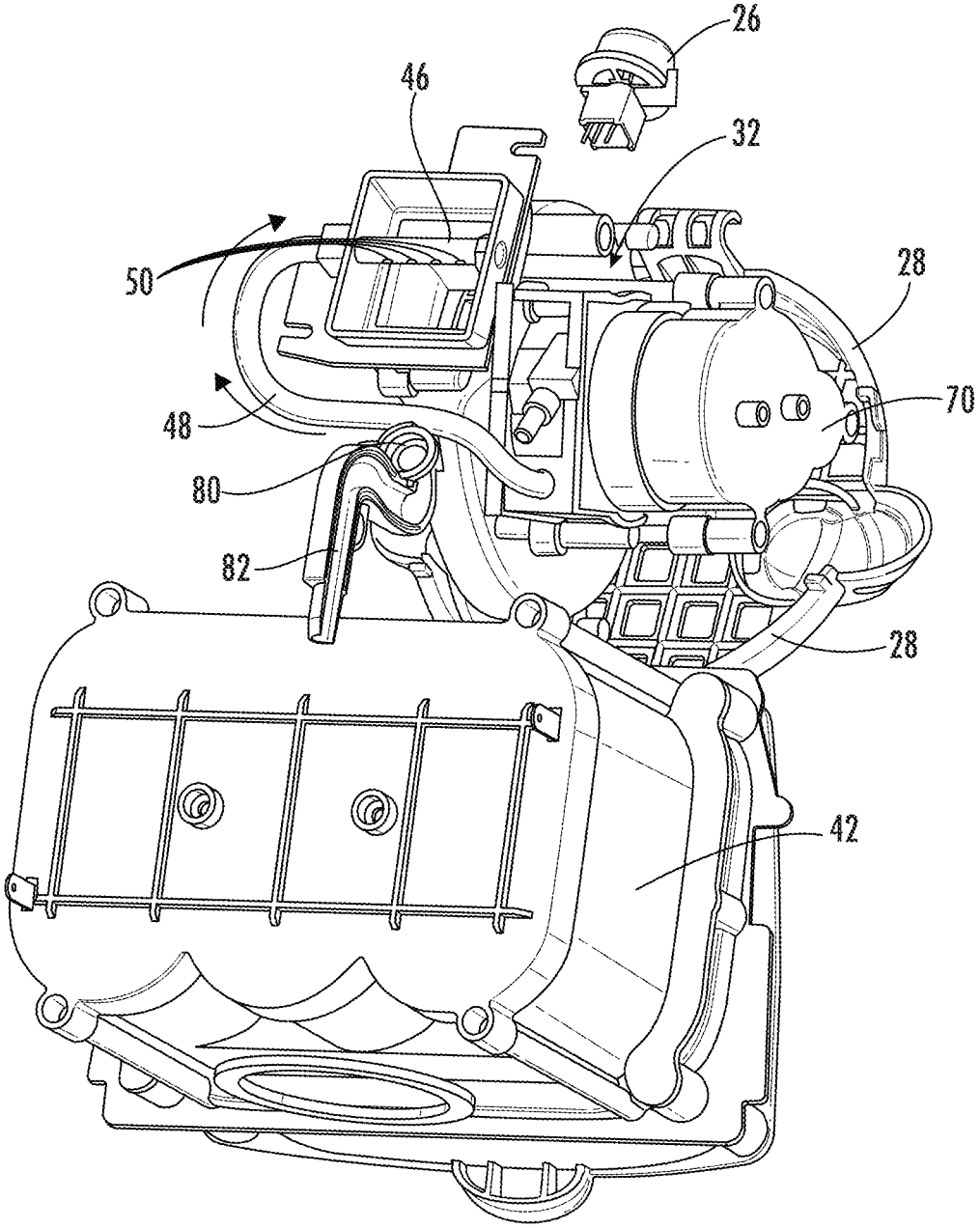
FIG. 7 is a bottom front perspective view showing the soap solution curtain nozzle.

Turning now to FIG. 7, a bottom front perspective view shows further details of the air blower 30, soap solution curtain nozzle 46 and gearing housing 38, again with outer housing portions 16, 18 removed for ease of illustration and discussion of the present invention. It should be noted that the input to the pump 32 is shown merely as an input end to the tubing 56 used in the pump, such as a peristaltic pump, as will be described in further detail below. In FIG. 7, the array of apertures 50 in the soap solution supply line 48 can be seen, which act as a multi-port nozzle 46 to direct soap foam solution 13 downwardly in a controlled curtain-like manner. For example, four apertures 50 may be provided but it should be understood that more or less than four apertures 50 can be employed depending on the amount of foam 12 is desired to be created, the size of the machine 10, and the like.

FIG. 8 shows another view of the machine 10 of the present invention with the gearing housing 38 removed to show the pump 32, preferably a peristaltic pump, and gearing linked to the motor 36 so the single motor 36 can simultaneously drive the air blower 30 and pump the soap foam solution 13 in the reservoir up 24 and through the nozzle apertures 50 at the free end of the soap foam solution line 46 residing in the air blower output port 31 of air blower 30. Details of the gearing, so the motor 36 can drive both the air blower 30 and the soap foam solution pump 32, are shown and discussed in the figures below, namely, FIGS. 11-12 below.

Figure 9:
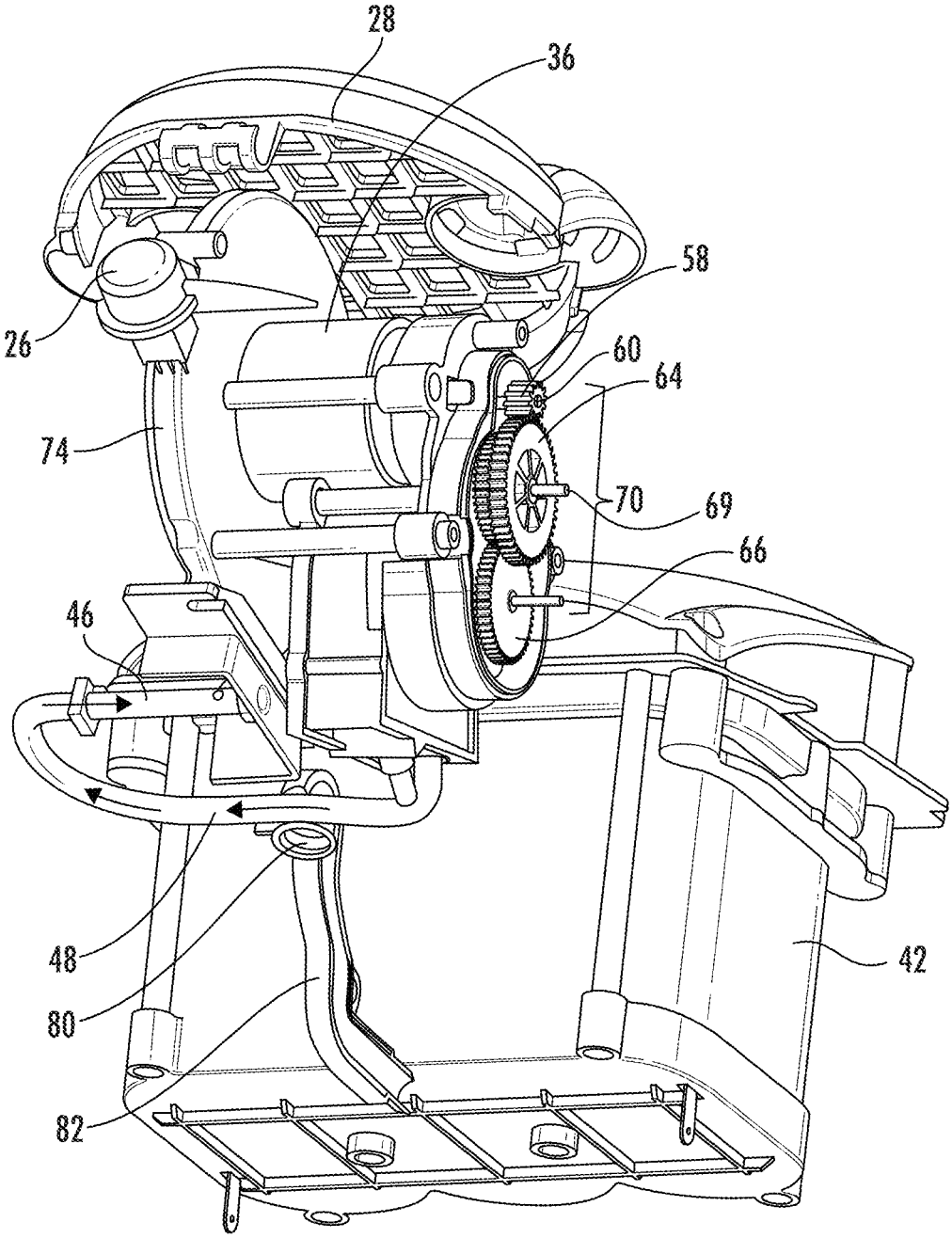
FIG. 9 is a top view of the machine of the present invention with housings removed for illustration purposes.

FIG. 9 is a top rear perspective view of the machine 10 of the present invention with outer housings 16, 18 removed for illustration purposes. The motor 36 can be seen in this view driving the peristaltic pump 32 via a series of gears. Thus, when the motor 36 rotates, the gear 58 residing on the free end of axle 60 includes teeth 62 that engages with pump gear 64 to drive the peristaltic pump 32 to pump the soap foam solution 13.

Figure 10:
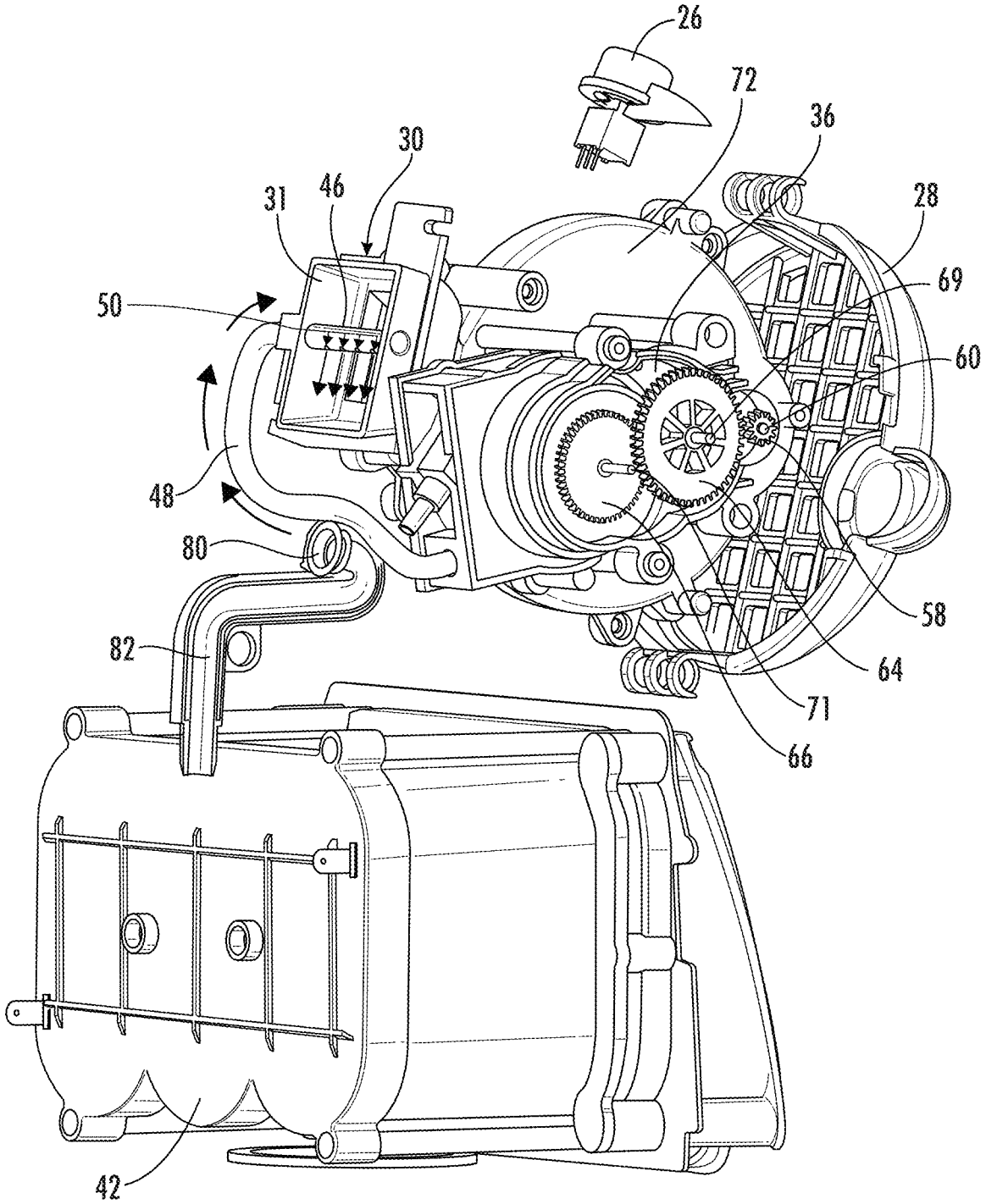
FIG. 10 shows a right side view of the machine of the present invention with housing removed to show the motor gearing for driving the pump.

In FIG. 10, which is a right-side perspective view of the machine 10 of the present invention with housings 16, 18 removed to show the gearing, further shows the motor 36 driving the gear array by one of the axles 60 of the electrically driven motor 36, namely, the pump axle 60 on the right side of the motor 36 in FIG. 9. Thus, when the pump axle 60 rotates, as powered by the motor 36, the gears 58, 64, 66 rotate to drive the soap foam solution pump 32.

Figure 11:
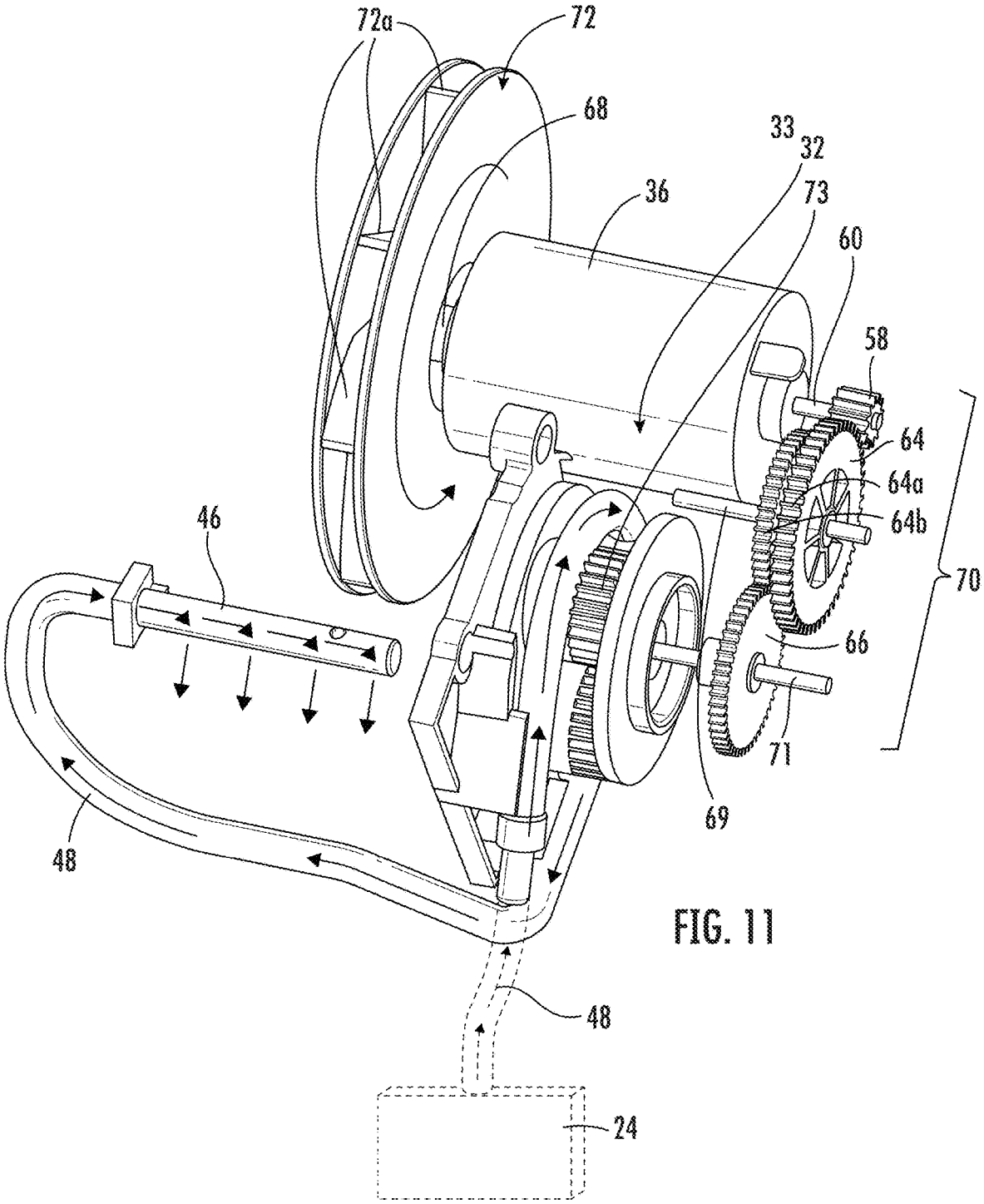
FIG. 11 is a top perspective view showing only the double axle motor that drives the pump and blower at the same time.

FIG. 11 is a top perspective view isolating on the electrically-powered double-axle motor 36 with the first axle 60 driving the pump gears (generally referred to as 70) to, in turn, drive the peristaltic pump 32 and a second axle 68 that drives the turbine 72 for the air blower 30 on the left side. More specifically, the motor 36 has a first axle 60 that emanates outwardly to the right in FIG. 11 with a first pump gear 58 affixed the free end of the first axle 60. The first pump gear 58 engages with a second pump gear 64 that includes a first set of teeth 64*a* and second set of teeth 64*b* thereon and rotates on axle 69. The first pump gear 58 communicates preferably with the first set of teeth 64*a* on the second pump gear 64. The second set of teeth 64*b* on the second pump gear 64 preferably rotates with the first set of teeth 64*a* about axle 69. Thus, the second pump gear 64 serves to change the rotational speed that is, in turn, imparted to the third pump gear 66, which is mounted to and drives the peristaltic pump 32 via axle 71. Pump 32 has its own internal gears 73 and rollers 33. While this gear configuration 70 is preferred, it is just an example of the gearing that may be provided in accordance with the present invention as other gear ratios and gear reduction techniques may be used to achieve the desired pump speed and direction and resultant soap foam solution 13 flow rates.

FIG. 11 also shows a fan turbine 72 connected to a second axle 68 on the opposing side of the motor 36 compared to the first axle 60 that drives the soap foam solution pump 32. The second axle 68 is preferably directly connected to the fan turbine 72 whereby the blades 72*a* of the turbine 72 radially emanate about the axis of the second axle 68 thereby blowing air 90 degrees offset from the rotational axis of the motor 36. As a result, the motor 36 can be positioned transversely in the housing 16 to facilitate the use of the opposing axles 60, 68 for two different purposes, namely, blowing air 74 and pumping soap foam solution 13 simultaneously.

It is should be understood that the above motor 36, motor axle 60, 68 and gear configuration 70 is preferred but other motor arrangement and gear configurations may be used and still be within the scope of the present invention. For example, although not preferred, it is possible that a single motor axle, such as the first axle 60, interconnect the first pump gear 58 with an additional set of gears compared to the pump gears 70 shown in FIG. 11. However, direct connection of a second axle 68 to the fan turbine 72 efficiently drives the fan blower 30 to blow air 74 in accordance with the present invention. The soap foam solution reservoir 24 is representationally shown in FIG. 11 to illustrate the path of the soap foam solution 13 and how it is pulled up into the soap foam solution supply line 48 from the soap foam solution reservoir 24 by the peristaltic pump 32. In FIG. 11, the air blower housing 31 is not shown so the soap foam solution supply line 48 can be clearly seen, namely its free end 46 with the array of aperture nozzles 50 to create the waterfall dispensing of the soap foam solution 13 in front of the blower output 30.

Figure 12:
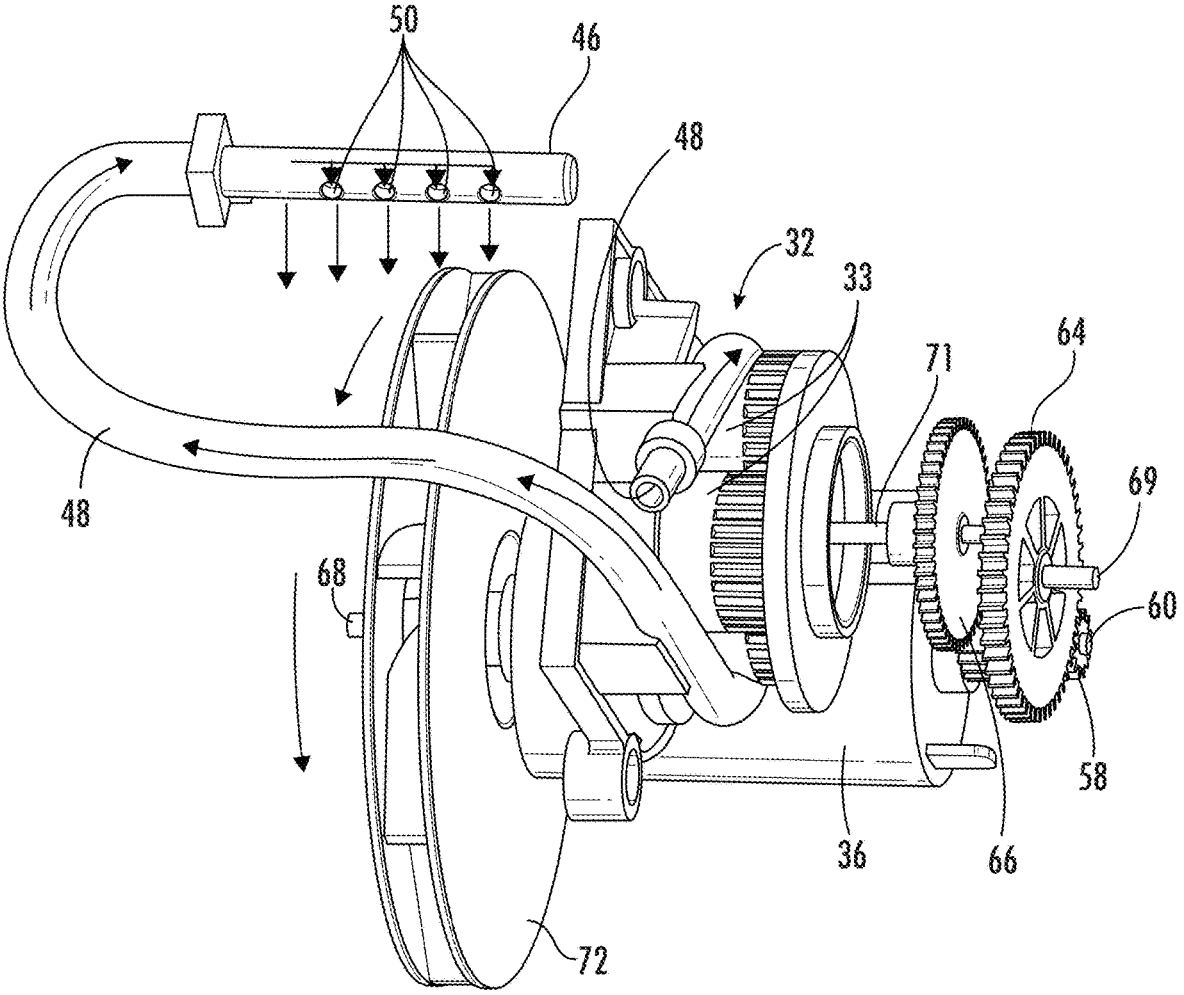
FIG. 12 is a bottom front perspective view of view of the components of FIG. 11 of the present invention.

FIG. 12 shows a further view of the components of FIG. 11 where the apertures 50 in the free end 46 of the soap foam solution line 48 can be seen. In the view of FIG. 12, the configuration of the peristaltic pump 32 can be clearly seen whereby the pump rollers 33 rotate in such a direction so that soap foam solution 13 is routed in a clockwise fashion when viewing the machine 10 from the right side to thereby pull the soap foam solution 13 up and through the soap foam solution supply line 48 and then to the "curtain" type nozzle free end 46 in front of the air blower 30.

It should also be noted that instead of an electrically-powered motor 36, a manual human-driven crank drive (not shown) may be used for simultaneously driving the soap foam solution peristaltic pump 32 and the turbine 72 for the air blower 30.

Figure 13:
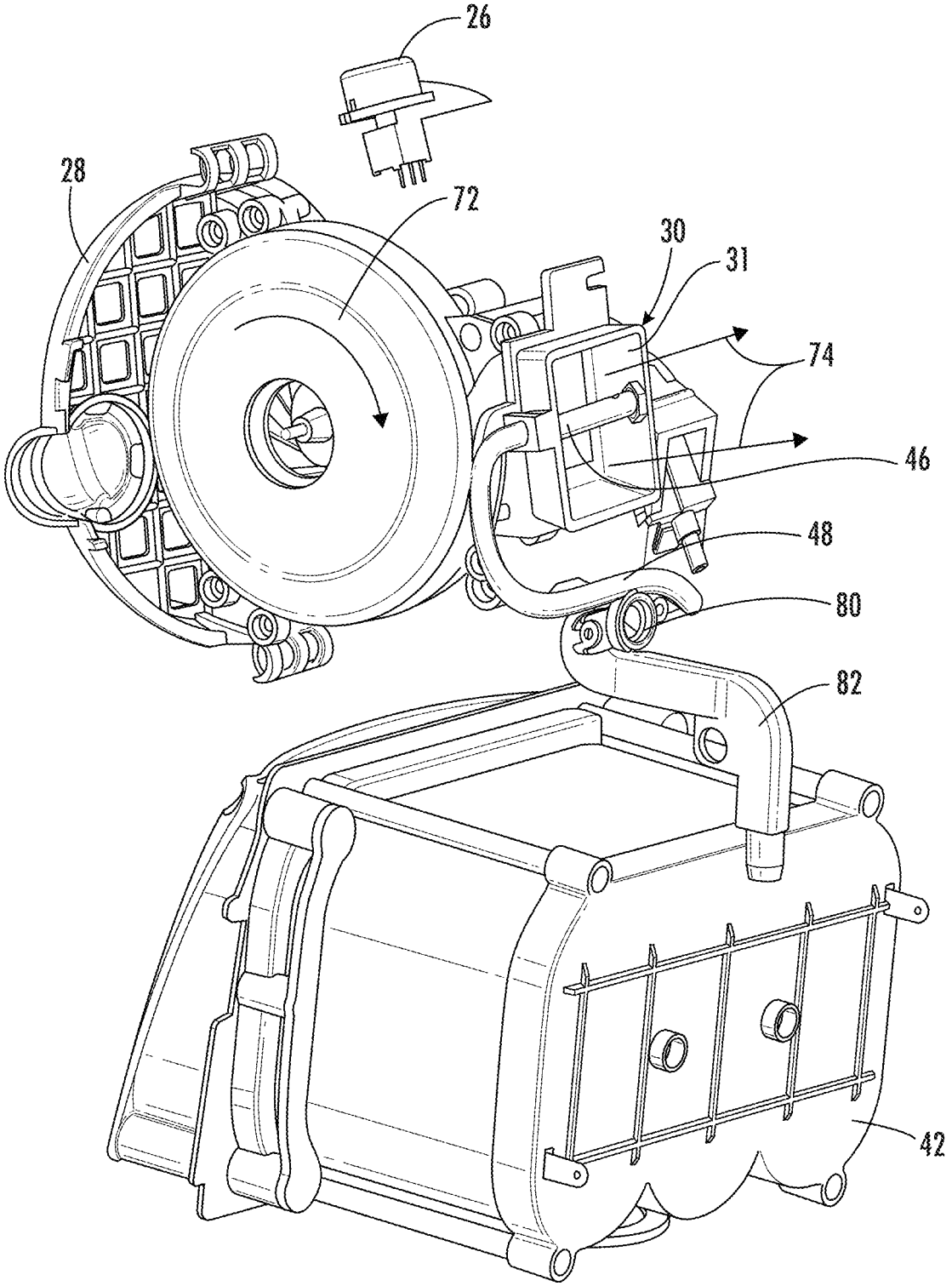
FIG. 13 shows a left side rear perspective view showing the blower in accordance with the present invention.
Figure 14:
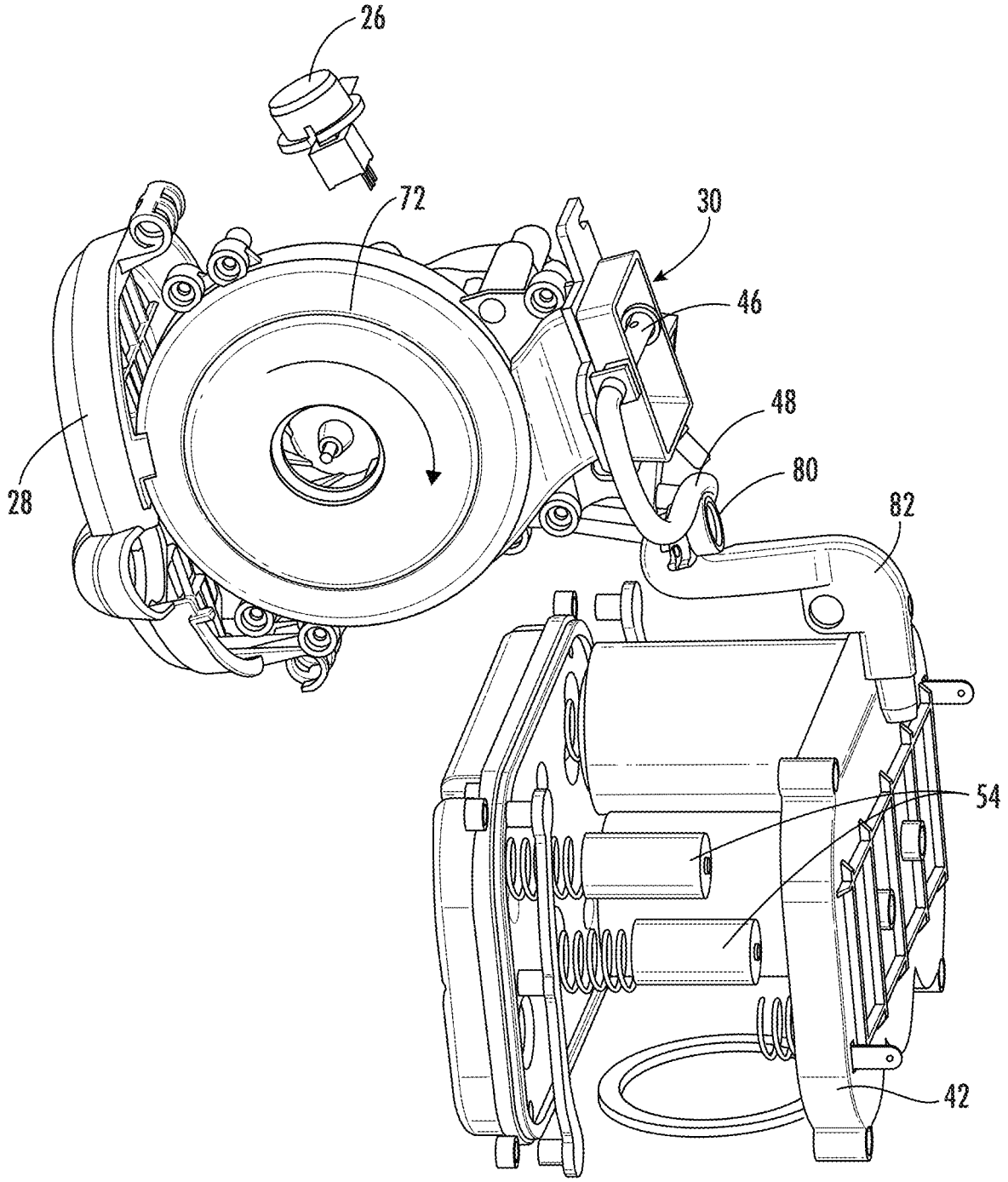
FIG. 14 is a side view of the machine of the present invention with battery compartment housing removed to show the storage of batteries therein for the supply of electricity to the motor.
Figure 15:
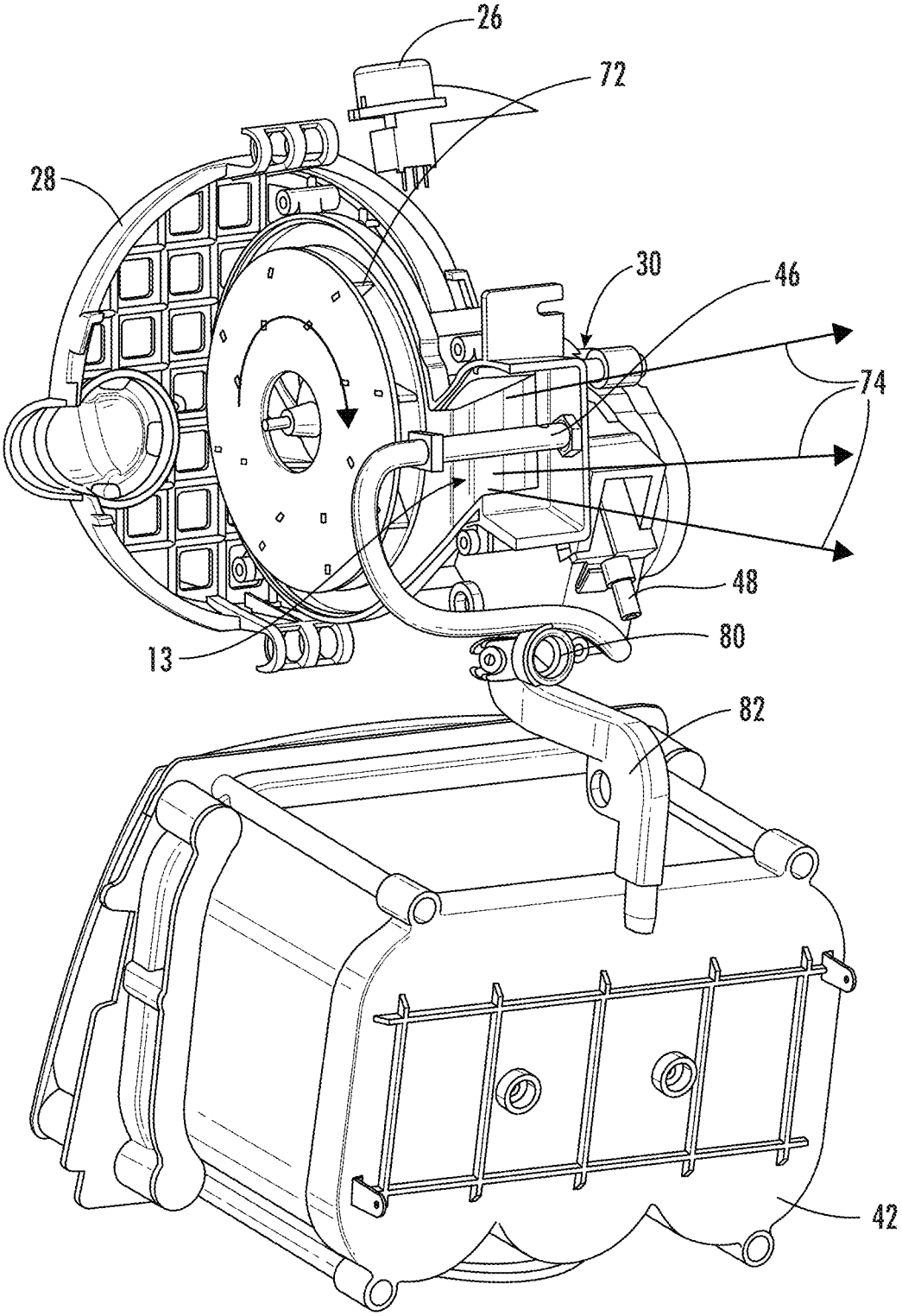
FIG. 15 is a left front perspective view showing the air blower mechanism of the present invention.

FIGS. 13-15 provide additional views of the machine 10 of the present invention where the details of the air blower 30 side of the machine 10 can be seen. FIGS. 13 and 14 show a left side perspective view showing the air blower 30 with battery compartment power supply housing 42 in place in accordance with the present invention. FIG. 14 also shows a portion of the battery compartment housing 42 removed for illustration purposes to reveal how batteries 54 are installed to provide the required electricity to drive the motor 36. While details of the electrical connectivity of the electrical output of the batteries 54 to the motor 36 is not shown in detail, it can be easily understood that electrical supply leads are routed to the motor 36 to power the motor 36 and cause the first and second axles 60, 68 to rotate, preferably in unison and simultaneously.

FIG. 15 shows yet another view of the air blower 30 and how it connects to the second axle 68 connected to the motor 36 but with the air blower housing 31 removed and a portion of the air output port 30 removed for illustration purposes. Thus, the turbine 72 blows air 74, supplied by the fan turbine 72 through the output port 31 of the air blower 30. Therefore, the fan turbine 72 and the output port 31 collectively provide the air blower component 30 to blow air 74 into the curtain of dripping soap foam solution 13 at 76 from the free end of the soap foam supply line 48. It should be noted that the free end 46 of the soap foam solution supply line 48 that has the curtain type nozzle with apertures 50 therein could be the same material as the remainder of the soap foam supply line 48, such as silicone tubing, nylon tubing, or the like. On the other hand, the curtain type nozzle at 46 may be a of a different type of material, such as metal, compared the to the remainder of the soap foam solution supply line 48. In that case, the nozzle end 46 of the soap foam solution line 48 would be connected in fluid communication with the soap foam solution line 48 with the use of appropriate seal interconnects for efficient dispensing of soap foam solution 13 in front of the air blower 30.

To use the soap foam generating machine 10 of the present invention, batteries 54 are installed into the battery compartment 24 to provide a supply of electricity to the motor 36. In the alternative, the machine 10 can operate on AC current, if desired. The ON/OFF switch 26, as can be seen in FIG. 1 and other figures, is turned ON to deliver electricity to the motor 36 from the batteries 54 to then cause both the first axle 60 (which drives the pump) and the second axle 68 (which drives the blower) to rotate simultaneously and in unison. On the free end of the first axle 60, a gear 58 is positioned that communicates with one or more other gears 64, 66 to drive a first axle 78 located at the peristaltic pump 32. As noted above, any number of gearing ratios can be employed to provide the desired translation of rotational force from the first axle 60 to the pump 32 to drive the pump 32. As can be seen, such as in FIGS. 11 and 12 above, the first axle 78 drives additional gears and rollers 33, about which the solution tubing 48 is wrapped, to provide the necessary pumping of soap solution 13 via a peristaltic configuration. Thus, soap solution 13 is pumped from a reservoir 24 (as shown schematically and discussed above in connection with FIG. 11) and then through the soap foam solution tubing supply line 48 and then up and through the output nozzle 46 of the tubing. For example, a reservoir 24 may reside below the machine 10 and include a soap solution line 48 that resides in the reservoir 24 to pull soap solution therefrom when the pump 32 is turned on. Also, it is possible that the reservoir 24 may be a separate bottle of soap solution 13 that is threadably attached to the bottom of the machine 10 whereby a dip line (an extension of line 48), that is fluidly connected to the soap solution line 48 inside the machine 10, is inserted into the bottle (not shown) before it is screwed into the bottom of the machine 10. Or, the dip line at the end of line 48 may be exterior to the machine 10 than can be placed in a supply reservoir 24 of soap foam solution 13 where the reservoir 24 is not attached in any way to the machine 10 itself.

The soap solution 13 is then directed through a soap solution output nozzle 46, which is preferably linear in configuration with a number of exit ports 50, such as at least one, to provide the aforementioned curtain or waterfall-like delivery of soap solution 13 by gravity in front of the air blower 30, which is simultaneously running. The air blower 30 urges the falling soap solution 13 forward into the mesh material 20 in the front output port 22 of the machine 10, which is preferably a fine mesh screen for example, as seen in FIG. 1, whereby air 74 is introduced into the soap solution 13 to create pockets of air within the soap solution 13. Thus, the soap solution 13 exits the machine in the form of voluminous foam or suds 12, as can be seen in FIG. 4. The fine mesh material 20, such as fabric, is preferably maintained saturated for optimal soap foam production. It is also possible to provide different sized mesh material 20 at the output of the machine 10, which would, in turn, generate different types of foam 12.

Referring back to FIG. 5 and other figures, the waterfall soap foam solution nozzle 46 is angled so any excess soap solution 13 that is not pushed through the mesh material 20 and turned into soap foam 12 falls back by gravity into the reservoir 24 to be re-pumped later.

Figure 16:
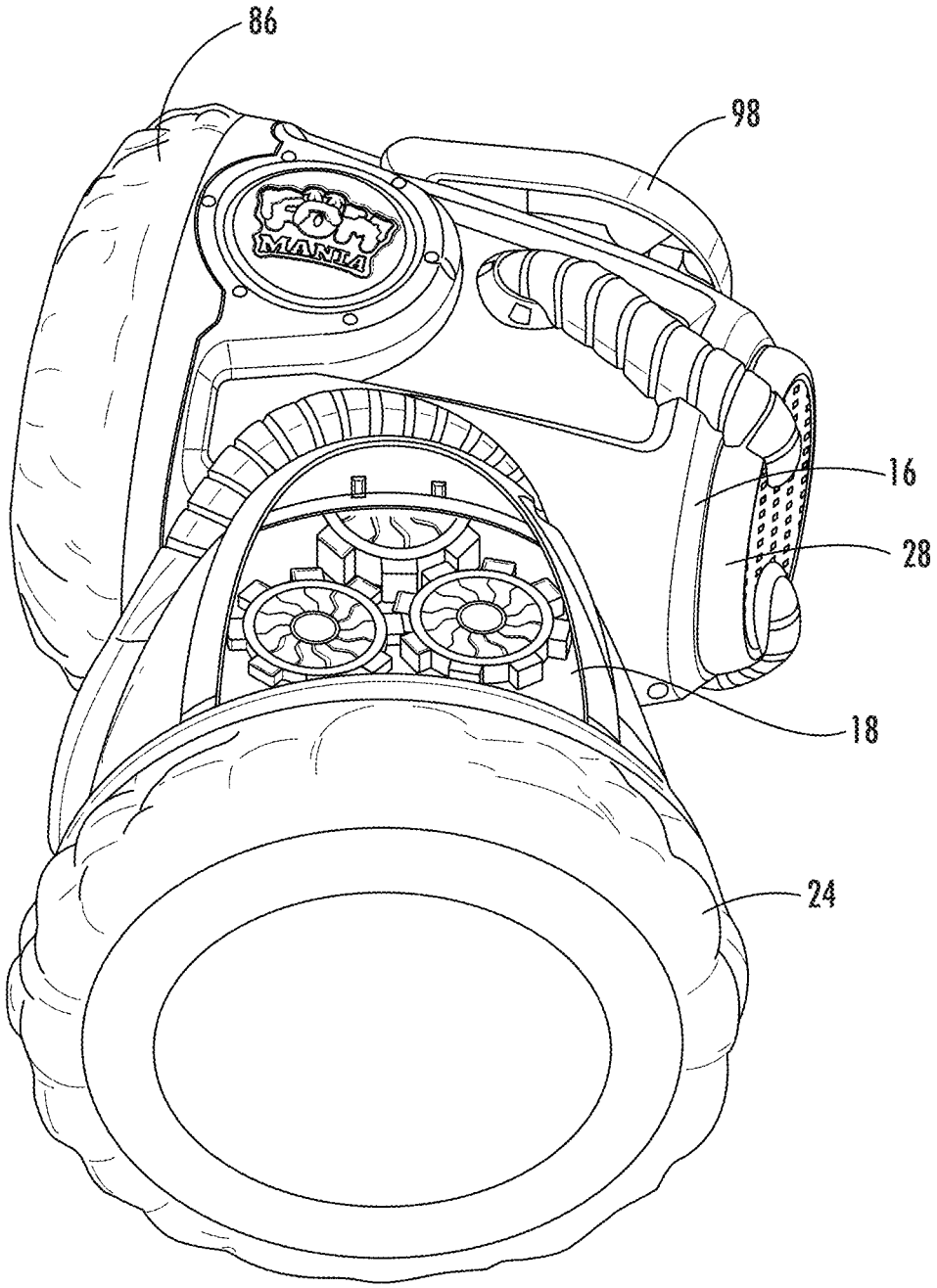
FIG. 16 shows a bottom perspective view of the machine of the present invention showing how the reservoir is fluidly connected to the soap solution line.
Figure 17:
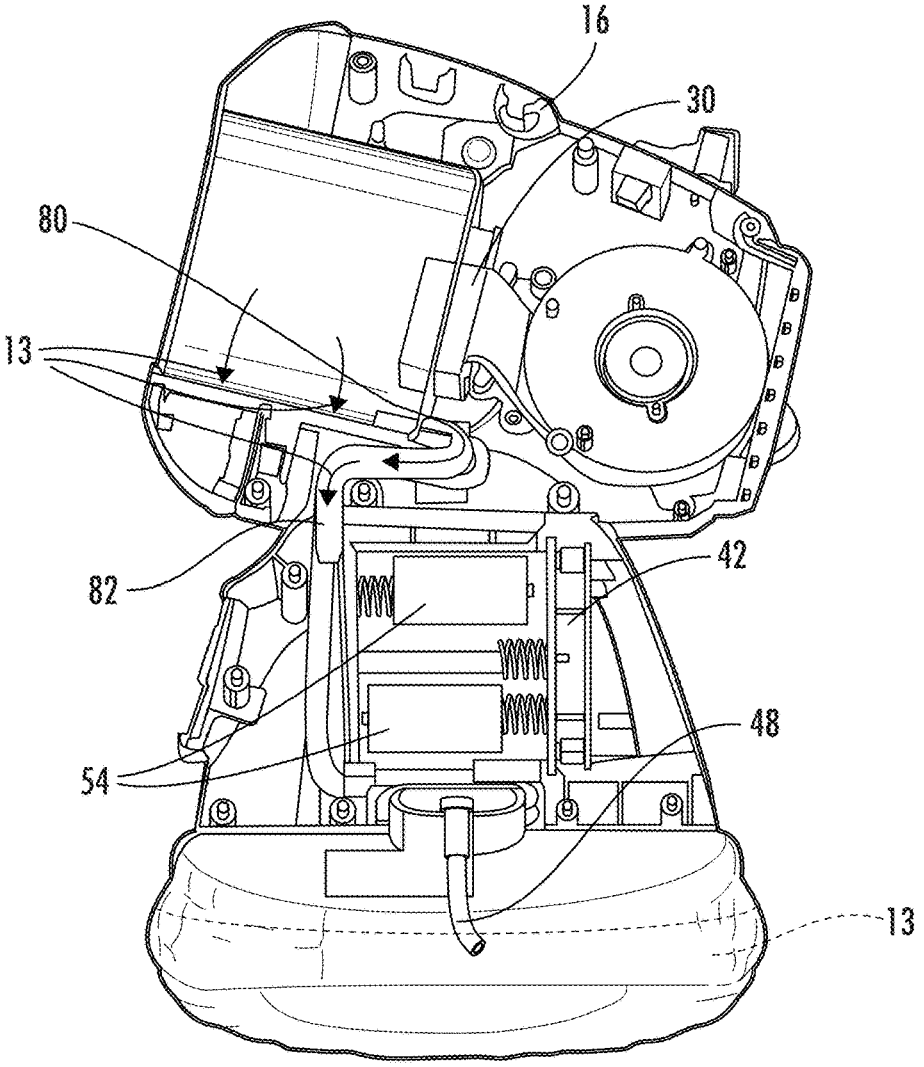
FIG. 17 shows a cross-sectional view through the line 17-17 of FIG. 16 showing how the pump tube reside in the reservoir to pull soap foam solution therefrom.
Figure 18:
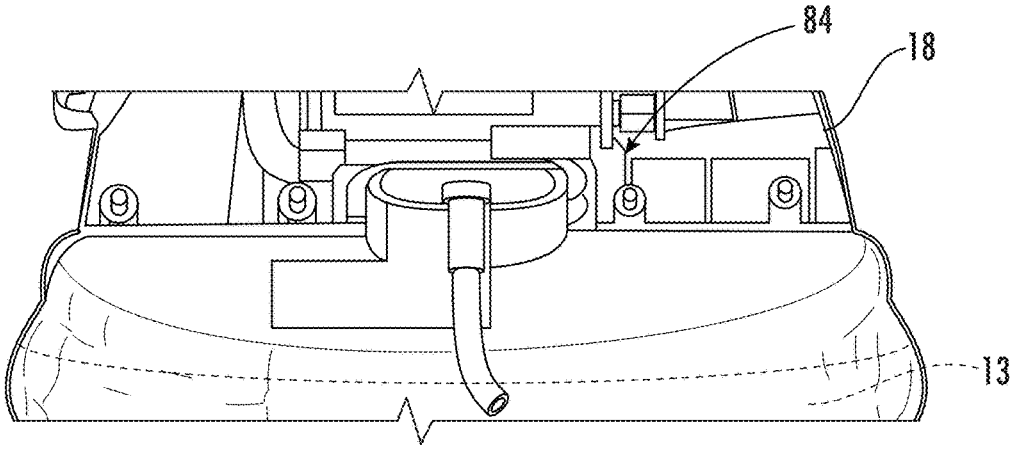
FIG. 18 shows how the reservoir releasable connects to the main body of the machine of the present invention.

FIGS. 16-18 show further details of the reservoir 24 and how the reservoir 24 is fluidly connected to the soap solution line 48 as well as how excess soap solution 13 falls back into the reservoir 24 via angled draining via a drain hole 80 that feeds back into the reservoir 24 via return line 82. More specifically, FIG. 16 shows the reservoir assembly in the configuration of releasably attached reservoir 24, such as by threading, friction fit, and the like, where it is attached to the bottom of the housing 18. Preferably, a threaded screw mounting 84 of the reservoir 24 can be seen in the close-up view of FIG. 18. The cross-sectional view of FIG. 17 further shows the route of pumped solution 13 from the reservoir 24 as well as how excess solution 13 falls back by angled draining into the reservoir 24 for further use via a drain hole 80 and tube 82 back to the reservoir 24.

Figure 19:
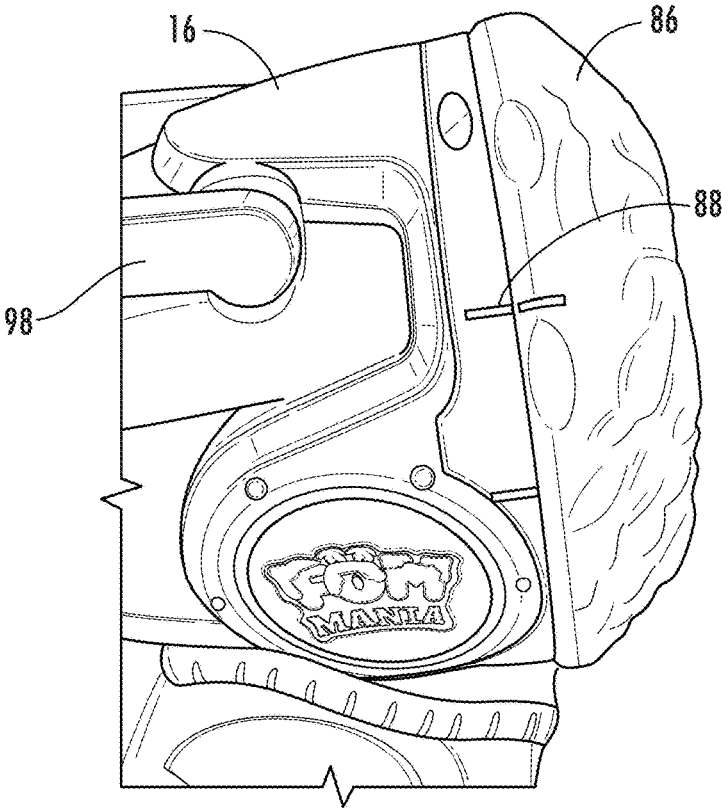
FIG. 19 shows a side elevational view of the machine showing how the front plate attaches in an aligned fashion to the main housing of the machine with the assistance of alignment indicator markings.
Figure 20:
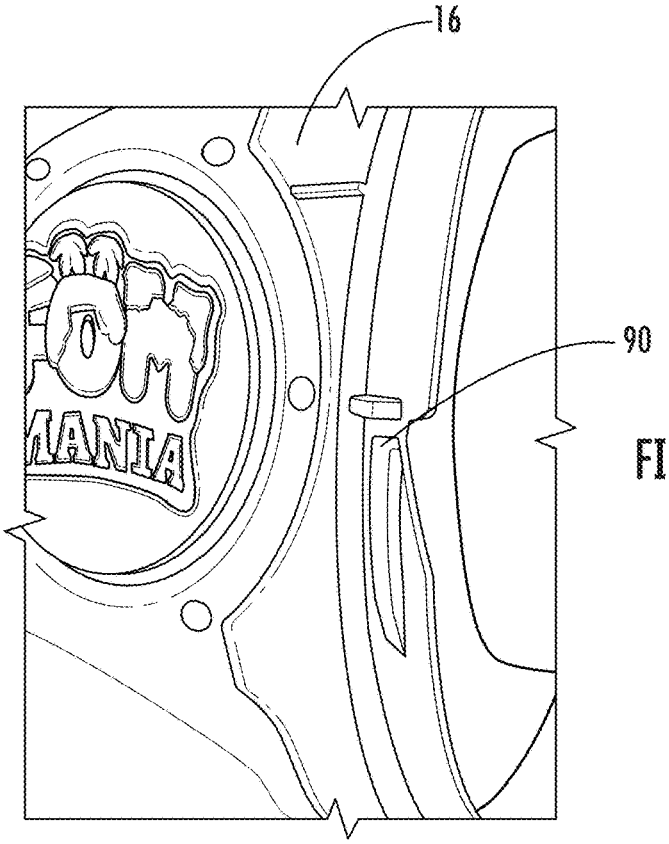
FIG. 20 shows a raised barbs on the main housing to lock the front plate thereon.
Figure 21:
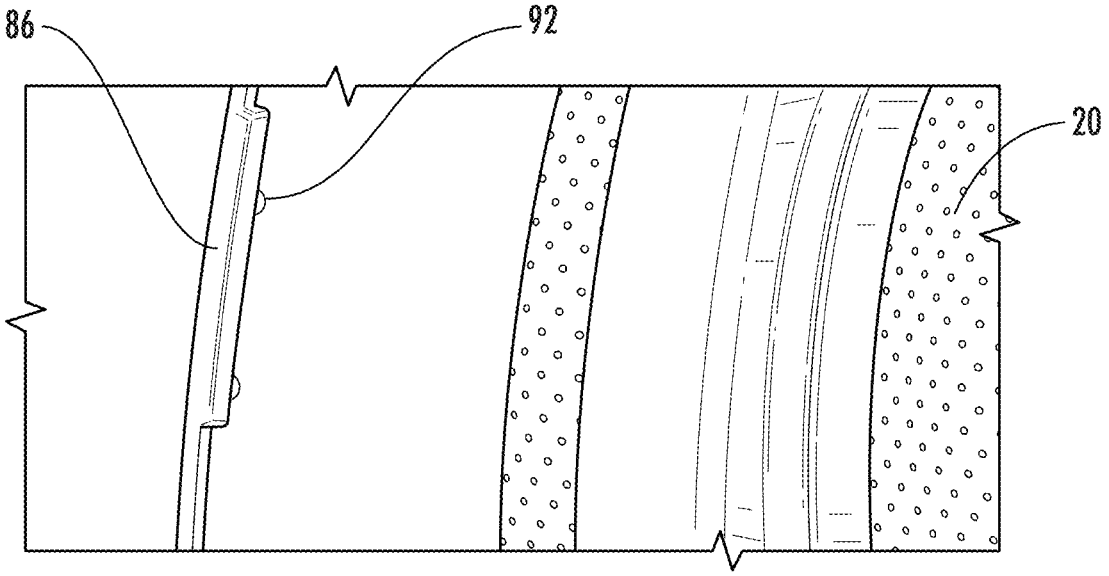
FIG. 21 shows raised barbs on the front plate that engage with the barbs on the main housing for interconnection thereto.

FIGS. 19-21 show additional features of the front plate 86 that holds the mesh material 20 in place at the front of the machine. The mesh material 20 may be secured to the front plate 86, which is, in turn, attached to the main housing 16 of the machine 10 of the present invention. The mesh material 20 may be heat sealed, glued, insert molded, and the like, to the front plate 86. Thus, when the front plate 86 is secured to the (upper) main housing 16 of the machine 10, the mesh material 20 is maintained in a taught condition in front of the output port 31 of the air blower 30 to receive the blown soap foam solution 13 therethrough, as seen in FIGS. 1 and 4. As seen in FIG. 19, the front plate 86 is preferably rotatable secured to the main housing 16 whereby alignment markers 88 on both the front plate 86 and main housing 16 are provided to show that these two components 16, 88 are properly aligned with each other for a secure fit. More specifically, this secure fit is preferably achieved by raised barbs 90 on the main housing 16, as in FIG. 20, which engage with complementary raised barbs 92 on the front plate 86 so the two structures may be locked relative to each to secure the front plate 86 in place with proper location and positioning of the mesh material 20 for receipt of blown soap foam solution 13. It should also be noted that other structures, such as threading, a press fit, bayonet connection, and the like, may be used on the front plate 86 and the main housing 16 instead to secure these components to each other for assembly.

Figure 22:
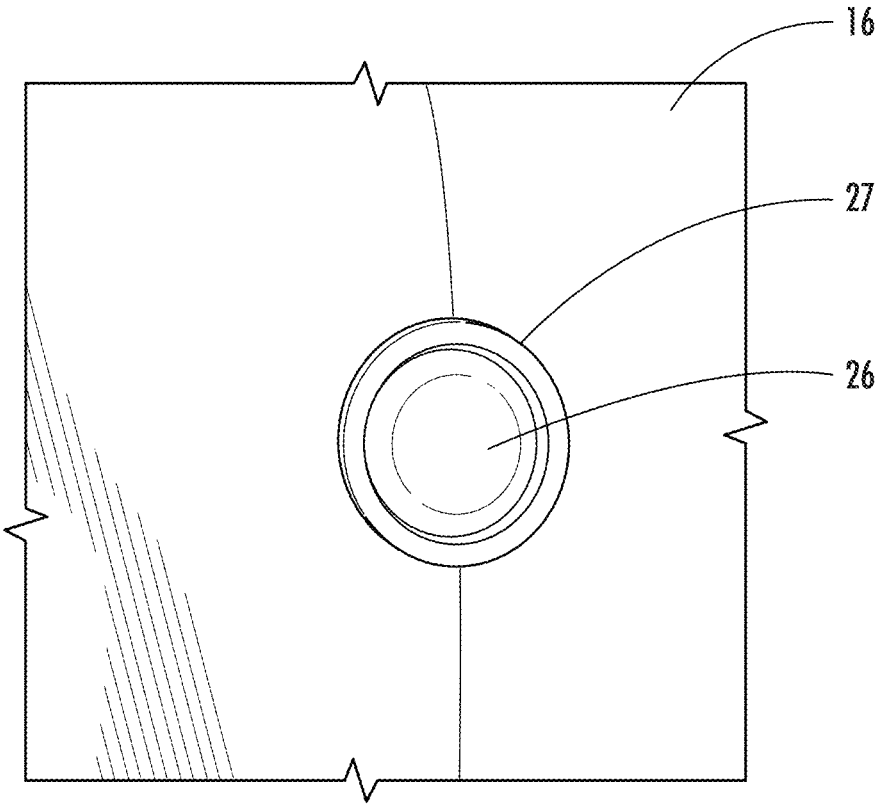
FIG. 22 shows a preferred raised perimeter ring about the ON/OFF switch on the top of the machine to prevent leakage of excess foam and soap foam solution into the housing.

FIG. 22 further shows another embodiment of power button 26 of the present invention where a raised perimeter ring 27 is positioned about the power button 26. This helps prevent leakage of foam 12, soap foam solution 13, and the like from leaking into the housing 16, 18 via the hole 94 in the main housing 16 through where the power button 26 is located.

Figure 23:
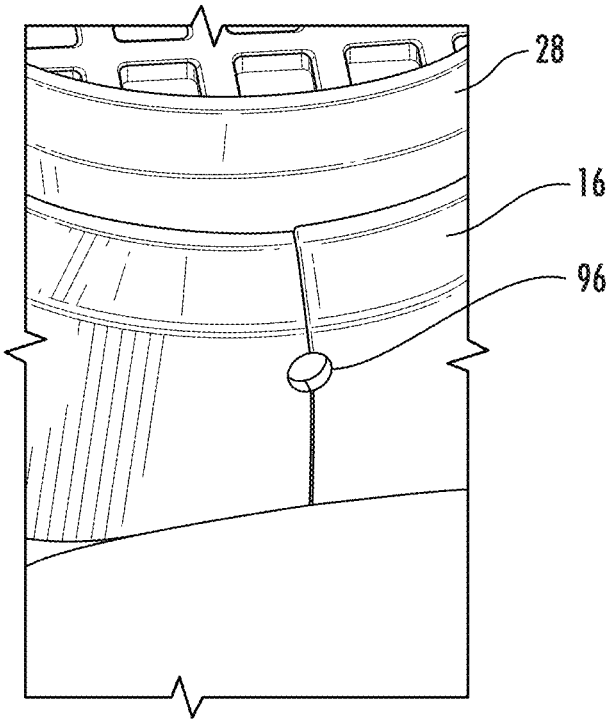
FIG. 23 shows a weep hole in a bottom portion of the housing to assist in drainage of excess foam and soap foam solution out of the machine.

FIG. 23 shows another embodiment of the air intake vent region 28 of the machine 10 of the present invention where a weep hole 96 is provided in the main housing 16 below the air intake vent region 28. Therefore, if any liquid 13 does enter the inside of the housing 16, it can more easily exit with the assistance of the weep hole. 96 The upward angle of the overall main housing 16 results in liquid 13 inside the main housing 16 dripping back toward the rear of the machine 10. Therefore, the weep hole 96 helps drain any such liquid 13 to keep the interior of the machine 10 as dry as possible and working properly.

Figure 24:
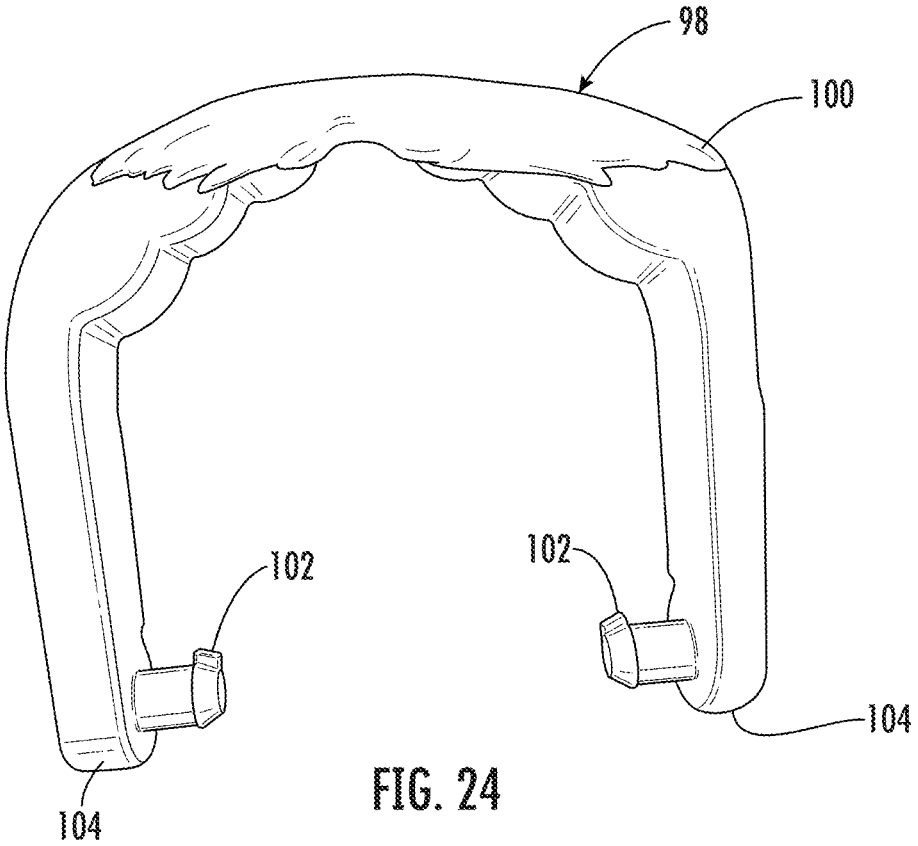
FIG. 24 shows the handle of FIG. 4 with raised bosses to help lock the handle on to the main housing.

The handle 98, that is seen in FIGS. 1 and 4, can be attached in many different ways. For example, as seen in FIG. 24, the handle 98 includes a bail portion 100 with raised bosses 102 on the free ends 104 thereof to lock the handle 98 to the main housing 16. The bosses 102 are respectively pushed into receiving seats 106 on opposite sides of the main housing 16, as can be seen in FIGS. 1 and 2, for example. The handle 98 may be pivotally attached to the main housing 16 in other ways, such as by the free ends 104 of the handle 98 being captured inside the main housing 16 using a cotter pin arrangement, and the like.

For the operation of the machine 10, the speed of the motor 36, the gearing 70 on the first axle 60 that drives the pump 32, the size of fan turbine 72 and shape of the air blower 30, soap solution nozzle 46 configuration and mesh material 20 are selected so that the desired combination of speed and volume of air 74 being blown into the mesh material 20 and pumping rate of soap solution 13 by the pump 32 provide the desired balance of air 74 to soap solution 13 being pumped to achieve the desired volume, density and flow of foam 12 generated by the machine 10 of the present invention. Such a balance also factors in the characteristics, such as viscosity, of typical soap solution 13 that is readily available and employed in common bubble and foam generation machines. This balance can be modified to suit a given machine 10, soap solution 13 and application at hand. The electronics related components are constructed of materials that are common for such components, such as insulated metal wires, metal springs for the battery compartment 24 and metal contacts to electrically interconnect with the batteries 54 therein.

It is also possible in the alternative that, instead of soap, only water is fed onto the mesh material that has been prepared with soap solution, such as by dipping the mesh material in a container or reservoir. The structure of the invention would be the same as above but the mesh material is first loaded with soap and water is placed in the reservoir instead of soap solution or pumped from a different location. Therefore, in this alternative embodiment, the pump pumps water through a liquid line and out through a nozzle. The turbine fan blows air into the water exiting the nozzle and then fed to the mesh material, previously loaded with soap solution thereon by dipping or the like, to generate soap foam through the soap foam outlet.

As can be understood, the various components shown above are assembled into a completed soap foam generating machine 10. The structural components of the present invention, namely the housing components 16, 18 and reservoir 24, are preferably made of injection molding plastic and can be secured in place in any fashion, such as by gluing, welding, heat sealing, or the like, to provide the final working machine 10 in accordance with the present invention. Silicone is preferred for the tubing 48 for the soap bubble solution lines 46 but nylon and other materials may be used for the tubing 48. The motor 36 and other electrical components are made with materials known in the art for such motors and electrical components.

In view of the above, the present invention uniquely provides the generation of quality and voluminous soap foam 12 by a portable cost-effective device 10.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A soap foam generating machine, comprising:
- a housing having a soap foam outlet;
- mesh material located at least partially over the soap foam outlet;
- a reservoir of soap solution;
- a drive; at least one axle being rotated by the drive;
- a pump being driven by the at least one axle via gears; the pump pumping soap solution from the reservoir through a soap solution line and out through a soap nozzle; and
- a turbine fan being driven by the at least one axle; the fan blowing air into the soap solution exiting the soap nozzle to drive the soap solution into the mesh material to generate soap foam through the soap foam outlet;
- wherein the soap nozzle is an array of apertures in the soap solution line where soap solution exits therefrom to provide a waterfall-like delivery of soap solution in front of the turbine fan.

2. The soap foam generating machine of claim 1, wherein the mesh material is fabric.

3. The soap foam generating machine of claim 1, wherein the drive is an electric motor or a human-driven crank.

4. The soap foam generating machine of claim 1, wherein the mesh material covers the soap foam output port or is internally located within the housing.

5. The soap foam generating machine of claim 1, wherein the pump is a peristaltic pump.

6. The soap foam generating machine of claim 1, wherein the drive has two axles connected thereto with one axle driving the pump and the other driving the turbine fan.

7. The soap foam generating machine of claim 1, wherein the gears are an array of gears where the rotational force of the drive is translated to a different force for driving the pump.

8. The soap foam generating machine of claim 1, wherein the soap nozzle is oriented horizontally.

9. The soap foam generating machine of claim 1, wherein the turbine fan rotates about an axis which is coaxial with the at least one axle of the drive.

10. The soap foam generating machine of claim 1, wherein the reservoir of soap solution is attached to the bottom of the machine where a dip tube resides therein which is in fluid communication with the soap foam solution supply line.

11. The soap foam generating machine of claim 1, further comprising:
- a weep hole in the main housing.

12. A soap foam generating machine, comprising:
- a housing having a soap foam outlet;
- mesh material;
- a reservoir of soap solution;
- a drive;
- a pump being driven by the drive; the pump pumping soap solution from the reservoir through a soap solution line and out through a soap nozzle; and a turbine fan being driven by the drive; the turbine fan blowing air into the soap solution exiting the soap nozzle to drive the soap solution into the fabric mesh to generate soap foam through the soap foam outlet;

wherein the soap nozzle is an array of apertures in the soap solution line where soap solution exits therefrom to provide a waterfall-like delivery of soap solution in front of the turbine fan;

wherein the drive simultaneously drives the pump and the turbine fan.

13. The soap foam generating machine of claim 12, wherein the mesh material is fabric.

14. The soap foam generating machine of claim 12, wherein the drive is an electric motor.

15. A soap foam generating machine, comprising:

a housing having a soap foam outlet;

mesh material configured and arranged with soap solution thereon;

a drive; at least one axle being rotated by the drive;

a pump being driven by the at least one axle via gears; the pump pumping water through a liquid line and out through a nozzle; the nozzle having at least one aperture; and a turbine fan being driven by the at least one axle; the fan blowing air into the water exiting the nozzle and into the mesh material with soap solution thereon to generate soap foam through the soap foam outlet.

16. The soap foam generating machine of claim 15, wherein the water is pumped from a reservoir of water.

17. The soap foam generating machine of claim 15, wherein the mesh material receives soap solution thereon by dipping into a soap solution.

* * * * *